US005746066A

United States Patent [19]

Manley

[11] Patent Number: 5,746,066

[45] Date of Patent: May 5, 1998

[54] PRE-FRACTIONATION OF CRACKED GAS OR OLEFINS FRACTIONATION BY ONE OR TWO MIXED REFRIGERANT LOOPS AND COOLING WATER

[76] Inventor: David B. Manley, 11480 Cedar Grove Rd., Rolla, Mo. 65401

[21] Appl. No.: 714,807

[22] Filed: Sep. 17, 1996

[51] Int. Cl.[6] ..... F25J 1/00

[52] U.S. Cl. ..... 62/612; 62/613; 62/619; 62/635

[58] Field of Search ..... 62/612, 613, 619, 62/935

[56] References Cited

U.S. PATENT DOCUMENTS

| | | | |
|---|---|---|---|
| 2,041,725 | 5/1936 | Podbielniak . | |
| 3,364,685 | 1/1968 | Perret . | |
| 3,768,273 | 10/1973 | Missimer . | |
| 4,230,533 | 10/1980 | Giroux . | |
| 4,256,476 | 3/1981 | Van Baush | 62/612 |
| 4,274,849 | 6/1981 | Garier et al. . | |
| 4,430,103 | 2/1984 | Gray et al. | 62/612 |
| 4,504,296 | 3/1985 | Newton et al. . | |
| 4,525,185 | 6/1985 | Newton . | |
| 4,539,028 | 9/1985 | Paradowski et al. . | |
| 4,545,795 | 10/1985 | Liu et al. . | |
| 4,720,293 | 1/1988 | Rowles et al. . | |
| 5,379,597 | 1/1995 | Howard et al. | 62/612 |

OTHER PUBLICATIONS

Mixed Refrigerant for ethylene (V. Kaiser et al, Hydrocarbon Processing Oct. 1976, pp. 129–131).

*Primary Examiner*—Ronald C. Capossela

[57] ABSTRACT

The present invention is a plurality of stages for partial condensation and phase separation a process gas stream, preferably containing substantial amounts of light olefins, methane, and hydrogen, but containing initially at least substantial amounts of methane and ethylene. Each condensation and separation stage is refrigerated with a subcooled and flashed high pressure liquid of a mixed refrigerant refrigeration loop, wherein throughout the loop the relative component ratios of the mixed refrigerant components are constant, contrasted with the several mixed refrigerant processes of the prior art where for all the streams of each closed refrigeration loop. In addition, rectification and/or stripping sections of an ethylene separation train have a common support construction taking advantage of relatively similar column diameters to reduce the total number of columns in the process.

24 Claims, 15 Drawing Sheets

PRE-FRACTIONATION OF CRACKED GAS OR OLEFINS FRACTIONATION BY ONE OR TWO MIXED REFRIGERANT LOOPS AND COOLING WATER

BACKGROUND OF THE INVENTION

The present invention relates to a mixed refrigerant process for multi-stage condensation of cracked gas via cascaded refrigeration.

U.S. Pat. No. 3,364,685 contains a description of a complex network of condensation and separation stages of a mixed refrigerant of at least methane, ethane, propane, butanes and pentanes (with optional nitrogen in small amounts). The object of the patent is generally to use the cascading refrigeration effect for mixed refrigerants shown in U.S. Pat. No. 2,041,725, condensed and separated as taught in that patent, to provide refrigeration for four separate refrigeration stages for natural gas condensation. The four refrigeration stages are chilled with mixed refrigerant compositions successively lighter in average molecular weight, as also described in U.S. Pat. No. 2,041,725. It will be apparent from inspection that maintenance of proper component ratios of the mixed refrigerants at each condensation, separation and vaporization stage for the mixed refrigerant will be quite difficult to achieve initially and also rather difficult to restore if upset occurs in the refrigeration load (i.e., the flow of natural gas) in the process condensers occur. Even gradual changes in flow rate of the condensing natural will require careful control of the pressures and flows of the mixed refrigerant. For every mixed refrigerant process where phase separation is used, component proportion control is to some degree a problem and affects vaporization temperature range for process condensation stages. U.S. Pat. No. 4,274,849 extends the cascade refrigeration art for liquefying natural gas to integrate a separate, second refrigeration loop with first refrigeration loop. The multiple refrigerant loop system is used to achieve low temperatures consistent with nitrogen removal. The mixed refrigerant in the lowest temperature loop contains up to 20 mole percent nitrogen and the balance in light paraffinic hydrocarbons. The mixed refrigerant of the lowest temperature loop is different at each process refrigeration stage. This phase separation is in general the teaching of U.S. Pat. No. 2,041,725—phase separation reduces heavy components in the vapor phase and then produces a refrigerant upon condensation whose vaporization (refrigeration) temperature is lower than that of the mixed refrigerant absent such separation. U.S. Pat. No. 4,504,296 follows the lead of U.S. Pat. No. 4,274,849 in using a two loop system with a mixed refrigerant of nitrogen, methane, ethane, propane and butane to liquefy natural gas. Substantially similar systems are used in U.S. Pat. Nos. 4,525,185 and 4,545,795. The above systems are notable for their closed loop configurations. Although rather difficult to operate in practice due to the need to maintain proper component proportions at the condensation, separation and refrigeration stages, the above systems are inherently less subject to upsets than open loop refrigeration systems.

Cracked gas, as used in this specification, shall mean pyrolyzed hydrocarbons derived from ethane, propane, butane, naphtha, gas oil or combinations thereof. It is known in the art that in general the most valuable of the components to be recovered from cracked gas is ethylene, although hydrogen, methane, ethane, propylene, propane and heavier olefinic C4's are also sufficiently valuable under some circumstances to be recovered separately. U.S. Pat. No. 4,720,293 describes a method of precooling a cracked gas via integration with a dephlegmator and a closed, mixed refrigerant cooling loop. The mixed refrigerant is condensed and sub-cooled by heat transfer with a demethanizer bottoms liquid and by autorefrigeration, where two liquid product streams are fed to the demethanizer and the light, hydrogen-rich gas containing substantial amounts of ethane and low levels of ethylene are sent to other recovery or for combustion in the cracking furnaces.

In the article "Mixed Refrigerant for ethylene" (V. Kaiser et al, Hydrocarbon Processing, Oct. 1976, pp. 129–131), an analysis was made for the use of mixed refrigerants in condensing duties for integration for the ethylene fractionation train. The refrigerant composition was 8, 37 and 55 mole percent for methane, ethylene and propylene respectively. A substantial reduction in the temperature difference between the condensing process stream and the mixed refrigerant vaporization was shown compared to the more typical propylene and ethylene refrigeration loops.

An example of the refinement of U.S. Pat. No. 2,041,725 is shown in U.S. Pat. No. 3,768, 273. A mixed refrigerant is composed such that a substantial amount of only one component vaporizes and/or condenses through four cascade refrigeration stages. Only one low temperature (40° F. to −300° F.) process refrigeration service is accommodated by this system. The mixed refrigerants are the halogenated light hydrocarbons. The efficacy of the system is believed to include improved start-up advantages. No phase separation is described for some of the embodiments.

U.S. Pat. No. 4,539,028, on the other hand, describes another mixed refrigerant cooling loop where the components are separated prior to their process cooling chores. This patent is unique in separating the vapor and liquid from flashing the condensed refrigerant and then using the separated vapor and liquid to cool the process stream in three sequential cooling stages.

SUMMARY OF THE INVENTION

The present invention is a plurality of stages for partial condensation and phase separation a process gas stream, preferably containing substantial amounts of light olefins, methane, and hydrogen, but containing initially at least substantial amounts of methane and ethylene. Each condensation and separation stage is refrigerated with a subcooled and flashed high pressure liquid of a mixed refrigerant refrigeration loop. Throughout the mixed refrigerant refrigeration loop, the relative component ratios are constant. No condensation and separation takes place with respect to the mixed refrigerants of the present invention. In the prior art, by contrast, most mixed refrigerant processes teach phase separation of partially condensed mixed refrigerants at some point in their closed refrigeration loops.

The high pressure, mixed refrigerant liquid is formed by compression of returning mixed refrigerant vapor and condensation of that vapor by heat transfer to a relatively high temperature heat sink, preferably cooling water. The high pressure, mixed refrigerant liquid is preferably sequentially autorefrigerated and subcooled by indirect heat transfer in the plurality of condensation and separation stages or by diversion of a portion of the subcooled and flashed high pressure liquid to a sequence of separate heat transfer devices.

For each condensation and separation stage, the high pressure, mixed refrigerant liquid is subcooled to about the temperature of the process gas leaving the condensation and separation stage. A portion of the high pressure, mixed refrigerant liquid is flashed to a sufficiently lower pressure to achieve thermodynamically efficient approach temperatures to the inlet and exit temperatures of the process gas for the condensation and separation stage. It is preferable that the flashing reduce the temperature of the high pressure, mixed refrigerant by only about 5° F. The vaporized mixed refrigerant from the second or subsequent condensation and separation stages is first compressed in compression stages separate from the highest pressure compression stage. These other compression stages compress the mixed refrigerant vapor from (1) the outlet pressure of a second or subsequent condensation and separation stage to (2) the outlet pressure of the mixed refrigerant of the condensation and separation stage immediately preceding the second or subsequent condensation and separation stage. It is preferable that the compression stages of a refrigeration loop be connected by a single shaft to a common driver. It is also preferable that the vapor compressed in each compression stage comprise (1) vaporized mixed refrigerant from one of the condensation and separation stages at a certain pressure and (2), except for the mixed refrigerant vapor from the final condensation and separation stage, mixed refrigerant compressed to the same certain pressure from the condensation An additional mixed refrigerant loop is optionally cascaded with the above first mixed refrigerant loop to provide lower temperatures for additional condensation and separation stages. It is preferable that the additional mixed refrigerant loop has only one compression stage and condensation and substantial subcooling provided by the first mixed refrigerant loop. It is further preferable that the pressure of the mixed refrigerant of the additional mixed refrigerant loop be chosen such that full condensation of that mixed refrigerant is achieved at a temperature near to the temperature of the process gas exiting the coldest condensation and separation stage of the first mixed refrigerant loop.

Alternatively, an added compression stage for the additional mixed refrigerant loop can be included in the present invention to produce extremely low temperatures for the condensation and separation stages refrigerated with that additional mixed refrigerant loop. In such a case, it would be acceptable and perhaps necessary to add to the components of the mixed refrigerants a more volatile component than methane, such as nitrogen.

The present invention is applicable to fractionation sequences required for olefins separation. The high purity ethylene product from that fractionation sequence requires a condensation stage whose cooling curve is relatively flat, i.e., since ethylene product is typically recovered as the overhead product of C2 splitter, the condenser for that splitter operates essentially at or near the condensation temperature of ethylene. Because the present invention is preferably used with multi-component process gases, it will be preferable to heat pump a C2 splitter in the manner of the prior art to condense the C2 splitter overhead to obtain an ethylene overhead product and reflux for the C2 splitter.

DETAILED DESCRIPTION OF THE INVENTION

The technology disclosed below improves the prior art cascaded mixed refrigerant loops. The present invention uses a mixed refrigerant whose vaporization curve closely matches the condensation curve of gases with light olefins, as in cracked gas. Although it is known that thermodynamic efficiency may be achieved by reducing the temperature difference between a process condensation curve and a refrigerant vaporization curve, the present invention discloses a choice of mixed refrigerant components, vaporization stage pressure levels and temperature ranges and process sequence steps, among other aspects, not contemplated by the prior art.

Example 1—Multilevel Mixed Refrigerant Process

Figure 1:
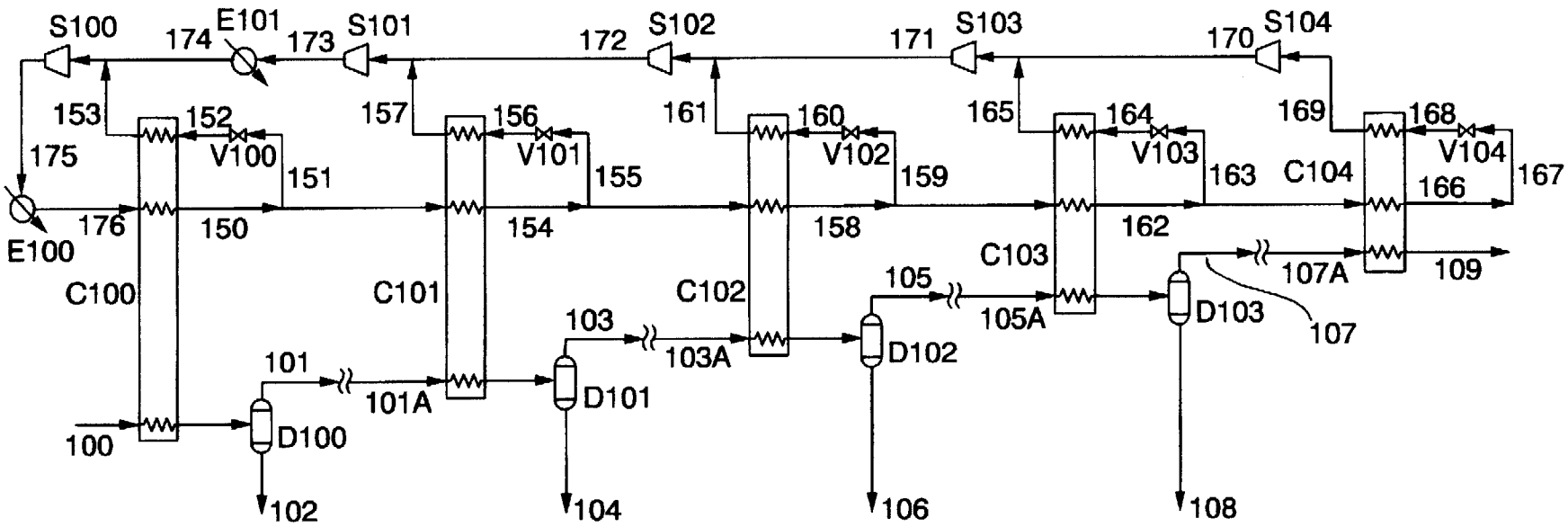
FIG. 1 is a single multi-refrigerant loop with five compression stages

The process of this Example 1 is generally shown in FIG. 1 and will be referred to as the "FIG. 1 process". As shown in FIG. 1 and further described in this Example 1, Table 1 gives compositions and conditions for the following streams:

| Stream No. | Stream Description |
|---|---|
| 100 | cracked or light olefins-containing gas |
| 101/A | vapor separated from condensation of stream 100 |
| 102 | liquid from condensation of stream 100 |
| 103/A | vapor separated from condensation of stream 101 |
| 104 | liquid from condensation of stream 101 |
| 105/A | vapor separated from condensation of stream 103 |
| 106 | liquid from condensation of stream 103 |
| 107/A | vapor separated from condensation of stream 105 |
| 108 | liquid from condensation of stream 105 |
| 109 | partially condensed stream 107 |
| 150,151 | mixed refrigerant subcooled in multi-stream or platefin exchanger C100 |
| 152 | stream 151 flashed across valve V100 |
| 153 | stream 152 vaporized in multi-stream or platefin exchanger C100 |
| 154,155 | mixed refrigerant subcooled in multi-stream or platefin exchanger C101 |
| 156 | stream 155 flashed across valve V101 |
| 157 | stream 156 vaporized in multi-stream or platefin exchanger C101 |
| 158,159 | mixed refrigerant subcooled in multi-stream or platefin exchanger C102 |
| 160 | stream 159 flashed across valve V102 |
| 161 | stream 160 vaporized in multi-stream or platefin exchanger C102 |
| 162,163 | mixed refrigerant subcooled in multi-stream or platefin exchanger C103 |
| 164 | stream 163 flashed across valve V103 |
| 165 | stream 164 vaporized in multi-stream or platefin exchanger C103 |
| 166,167 | mixed refrigerant subcooled in multi-stream or platefin exchanger C104 |
| 168 | stream 167 flashed across valve V104 |
| 169 | stream 168 vaporized in multi-stream or platefin exchanger C104 |
| 170 | stream 169 compressed in compression stage S104 |
| 171 | streams 165 and 170 compressed in compression stage S103 |
| 172 | streams 161 and 171 compressed in compression stage S102 |
| 173 | streams 157 and 172 compressed in compression stage S101 |
| 174 | stream 173 cooled in water cooled heat exchanger E101 |
| 175 | streams 153 and 174 compressed in compression stage S100 |
| 176 | stream 175 condensed in water cooled heat exchanger E100 |

In FIG. 1, drums D100, D101, D102 and D103 separate the vapor and liquid of streams 100, 101, 103, and 105, respectively, after those streams are partially condensed in multi-stream or platefin exchangers C100, C101, C102, and C103, respectively.

FIG. 1 shows a five level mixed refrigeration process. At the process stream condensation stages (multi-stream or platefin exchangers C100, C101, C102, C103 and C104), inlet temperatures of the process streams 100, 101, 103, 105, and 107 to those multi-stream or platefin exchangers lie within the range 100° F. to −91° F. Although it is preferable to use the present invention with process gases containing significant amounts of light olefins, methane and hydrogen, other gases may be advantageously condensed using a cascaded refrigeration method as described herein.

Streams 101, 103, 105 and 107 are shown on FIG. 1 as continuing to streams 101A, 103A, 105A and 107A, respectively. The break and continuation of the stream lines for those streams has the following meaning with regard to the present invention. Olefins fractionation generally requires stepwise condensation for the rectification process in the fractionation steps, identified as demethanization, deethanization, depropanization, and C2 splitting (deethylenization). The present invention extends to the use of the process condensation in multi-stream or platefin exchangers C100, C101, C102, C103 and C104 for condensing duties in the rectification sections of the above fractionation steps. Condensing duties may occur in physical devices such as an overhead condenser, a partial or full intercondenser, dephlegmators or other associated heat integration wherein refrigeration is cascaded to rectification in the fractionation steps. It is an important object of the present invention to use the refrigeration of the mixed refrigerant system to supply at least in part the condensing duty of the above olefins fractionation steps. Compositions of the process gas streams at the condensation and separation stages will necessarily be at least somewhat different from those shown in Tables 1 and 2 where rectification sections are interposed between the condensation and separation stages of the present embodiments of FIGS. 1 and 2.

Inspection of the general composition of streams 100,101, 103,105 and 107 indicate their analogy to streams within the olefins fractionation steps which are typically at least partly condensed with external refrigeration. Such analogous streams may be identified by the predominant components or relative component compositions in the liquid product streams 102,104,106 and 108. A propylene refrigeration cycle conventionally used for this purpose is limited to a minimum temperature of about −40° F. in order to avoid a vacuum in the low pressure drum and to avoid the associated high volumetric flows to the first stage compressor. Lower minimum temperatures could be achieved if an appropriate lower boiling refrigerant were available. However, ethane, an available and economic candidate, becomes supercritical at ambient temperatures and cannot be used as a replacement for propylene. Consequently, an ethylene refrigeration cycle is conventionally cascaded with the propylene cycle to reach refrigeration below −40° F. According to the present invention, a mixture comprising ethylene, propylene, and/or other light hydrocarbons effectively lowers the lowest temperature which can be practically or economically reached using a single refrigeration loop with a multistage compressor. An associated advantage of a multi-stage compressor refrigeration loop is the ability to condense refrigerant at a relatively high refrigeration condensing pressure and temperature. Although not shown in FIG. 1, cooling water requirements for the process are targeted for a minimum value.

The mixed refrigerant (stream 175), consisting substantially of ethylene, ethane, propylene, and propane, is completely condensed at 100° F. and 525 psia using cooling water in exchanger E100. The present invention establishes the following optimization criteria for highly efficient use of mixed refrigerant vaporization in the multi-stream or platefin exchangers. The condensed mixed refrigerant of stream 176 is subcooled in multistream or platefin exchanger C100 to form stream 150 by autorefrigeration. A portion of stream 150 is diverted to stream 151 and flashed across valve V100 to form stream 152. It is preferable to suppress excessive flashing across valve V100 by subcooling the mixed refrigerant in stream 150 sufficiently so that the temperature difference between streams 151 and 152 is about 5° F.

Although the approximate refrigeration load of multi-stream or platefin exchanger C100 can be determined by the desired process stream condensation with some additional requirement for subcooling the mixed refrigerant stream 176, a careful balancing of the pressure levels of streams 151 and 152 will permit the designer to achieve the combined refrigeration of the process stream and the mixed refrigerant with the vaporization and heating of stream 152 to stream 153 while maintaining about 5° F. difference between streams 151 and 152. Thus a minimum approach temperature is obtained between refrigerating stream 152 and cooled stream 150. Excessive flashing reduces the temperature of stream 152 and "wastes" or creates an unnecessarily large approach temperature between stream 150 and 152. Unnecessarily large approach temperatures between refrigeration streams and cooled streams result in thermodynamic inefficiency.

The refrigerant pressure for stream 152 is about 340 psia. At that pressure, the mixed refrigerant stream 152 is heated to about 90° F. to form stream 153. The approach temperature of about 10° F. between refrigerating stream 153 and cooled streams 100 and 176 was achieved.

Figure 6:
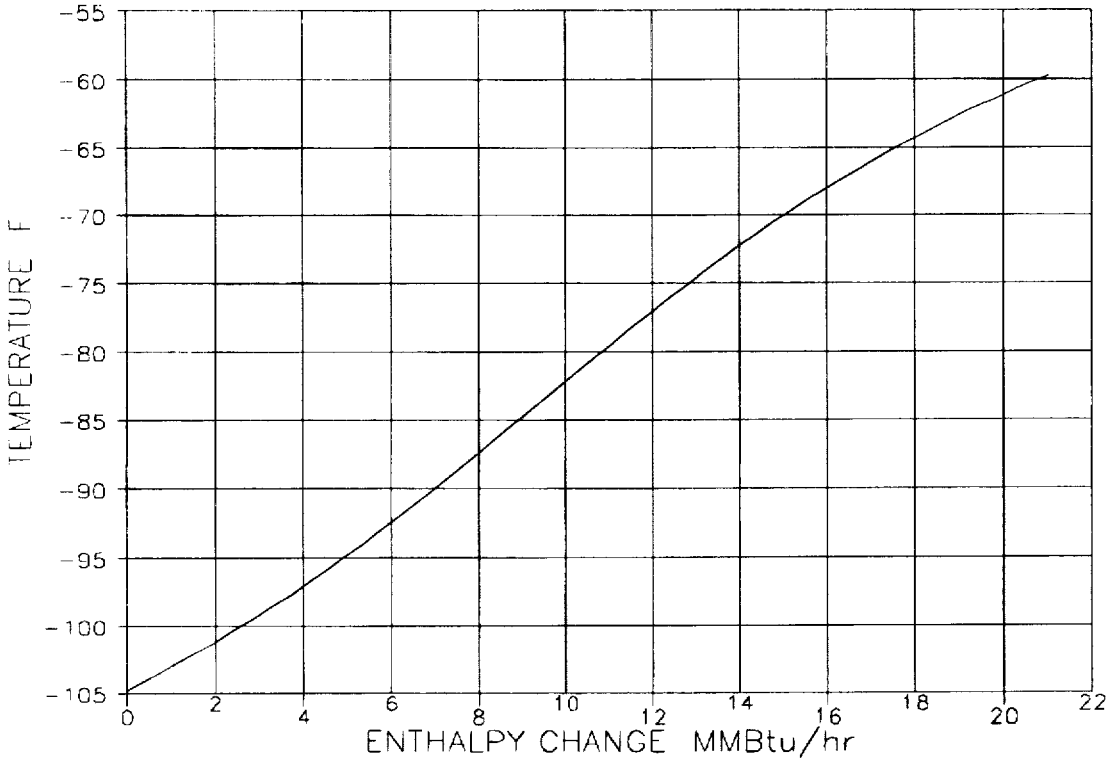
FIGS. 6 and 7 show the smooth, slightly convex vaporization curves of the first and second mixed refrigerants of Example 2 below.

The composition of the mixed refrigerant in this example is chosen so that the refrigerant condensation, in exchanger E100, is at a practical maximum of about 525 psia, so that the heating curve for the mixed refrigerant is approximately linear or slightly convex. The shape of the heating curve, as shown in FIG. 6, will indicate to the skilled person that the highest pressure of the compression stages, such as at the outlet of stage S100, relative amounts of the mixed refrigerant components in this example or alternate components to those in the mixed refrigerant might be varied effectively to obtain a heating of approximately the same shape.

The completely vaporized mixed refrigerant of stream 153 is mixed with stream 174, the compressed refrigerant, intercooled in exchanger E102, from the lower pressure stages, multi-stream or platefin exchangers C101, C102, C103 and C104. Stage S100 compresses the combined streams 153 and 174 to about 525 psia, sufficient for complete condensation with cooling water.

The refrigeration loop described above is generally a single cycle mixed refrigeration process operating from 60° F. to 90° F. and providing refrigeration to cool the process stream 100 from about 100° F. to about 65° F. Multistream heat exchangers are used in the example process because of their thermodynamic efficiency, low cost, and industrial acceptance. However, heat exchangers with two separate tube bundles may also be used by splitting stream 152, using a first portion to cool the process stream 100, and using the remaining portion to subcool the refrigerant stream 176. Because the refrigerant composition has been chosen for its almost linear vaporization curve, it will closely match with the sensible subcooling curve of the refrigerant. The resulting process using two stream heat exchangers will retain high thermodynamic efficiency.

The association of process and refrigeration streams, multi-stream or platefin exchangers and compressor stages are substantially similar for the subsequent refrigeration/subcooling/condensation stages for the process stream. The refrigeration loop associated with multi-stream or platefin exchanger C101 cools the process stream 101/A from about 65° F. to about 30° F. using refrigeration temperatures from about 25° F. to about 60° F. The pressure of mixed refrigerant streams 154 and 155 is about 340 psia and is reduced across valve V102 to about 222 psia to form stream 156, wherein a 5° F. temperature drop is achieved. Stream 156 is vaporized in multi-stream or platefin exchanger C102 to form stream 157. The completely vaporized mixed refrigerant of stream 157 is mixed with stream 172, the compressed mixed refrigerant vapor stream from the subsequent stages (the lower pressure stages, multi-stream or platefin exchangers C102, C103 and C104). That mixed stream is compressed in stage S101 to about 340 psia to form stream 173. Stream 173 is intercooled, but not condensed, in exchanger E101 to form stream 174.

The refrigeration loop associated with multi-stream or platefin exchanger C102 cools the process stream 103/A from about 30° F. to about −8° F. using refrigeration temperatures from about −13° F. to about 25° F. The pressure of mixed refrigerant streams 158 and 159 is about 222 psia and is reduced across valve V102 to about 129 psia to form stream 160, wherein a 5° F. temperature drop is achieved. Stream 160 is vaporized in multi-stream or platefin exchanger C102 to form stream 161. The completely vaporized mixed refrigerant of stream 161 is mixed with stream 171, the compressed refrigerant from the lower pressure stages, multi-stream or platefin exchangers C103 and C104. Stage S102 compresses the combined streams 161 and 171 to about 222 psia to form stream 172.

The refrigeration loop associated with multi-stream or platefin exchanger C103 cools the process stream 105/A from about −8° F. to about −49° F. using refrigeration temperatures from about −54° F. to about −13° F. The pressure of mixed refrigerant streams 162 and 163 is about 129 psia and is reduced across valve V103 to about 64 psia to form stream 164, wherein a 5° F. temperature drop is achieved. Stream 164 is vaporized in multi-stream or platefin exchanger C103 to form stream 165. The completely vaporized mixed refrigerant of stream 165 is mixed with stream 170, the compressed refrigerant from the lower pressure stages, multi-stream or platefin exchanger C104. Stage S103 compresses the combined streams 165 and 170 to about 129 psia to form stream 171.

The refrigeration loop associated with multi-stream or platefin exchanger C104 cools the process stream 105/A from about −49° F. to about −91° F. using refrigeration temperatures from about −96° F. to about −54° F. The pressure of mixed refrigerant streams 166 and 167 is about 64 psia and is reduced across valve V102 to about 26 psia to form stream 168, wherein a 5° F. temperature drop is achieved. Stream 168 is vaporized in multi-stream or platefin exchanger C104 to form stream 169. Stage S104 compresses the stream 169 to about 64 psia to form stream 170.

In the FIG. 1 process, several thermodynamic efficiencies have been achieved. First, close temperature approaches have been achieved in all heat exchangers by closely matching the net refrigerant heating curve with the cooling curve of the process. Second, by subcooling the mixed refrigerant before flashing through the refrigeration valves, unnecessary vaporization losses have been minimized thus reducing compressor loads. Third, separation and remixing of vaporized refrigerants-with different compositions disclosed in the prior art has been eliminated thus maximizing the condensing temperature of the compressed gases. Finally, a sloped condensing curve for the compressed refrigerant is generated thus greatly reducing the cooling water requirement in comparison with-conventional single component refrigeration cycles.

Example 2—Cascaded Multilevel Mixed Refrigeration Process

Figure 2:
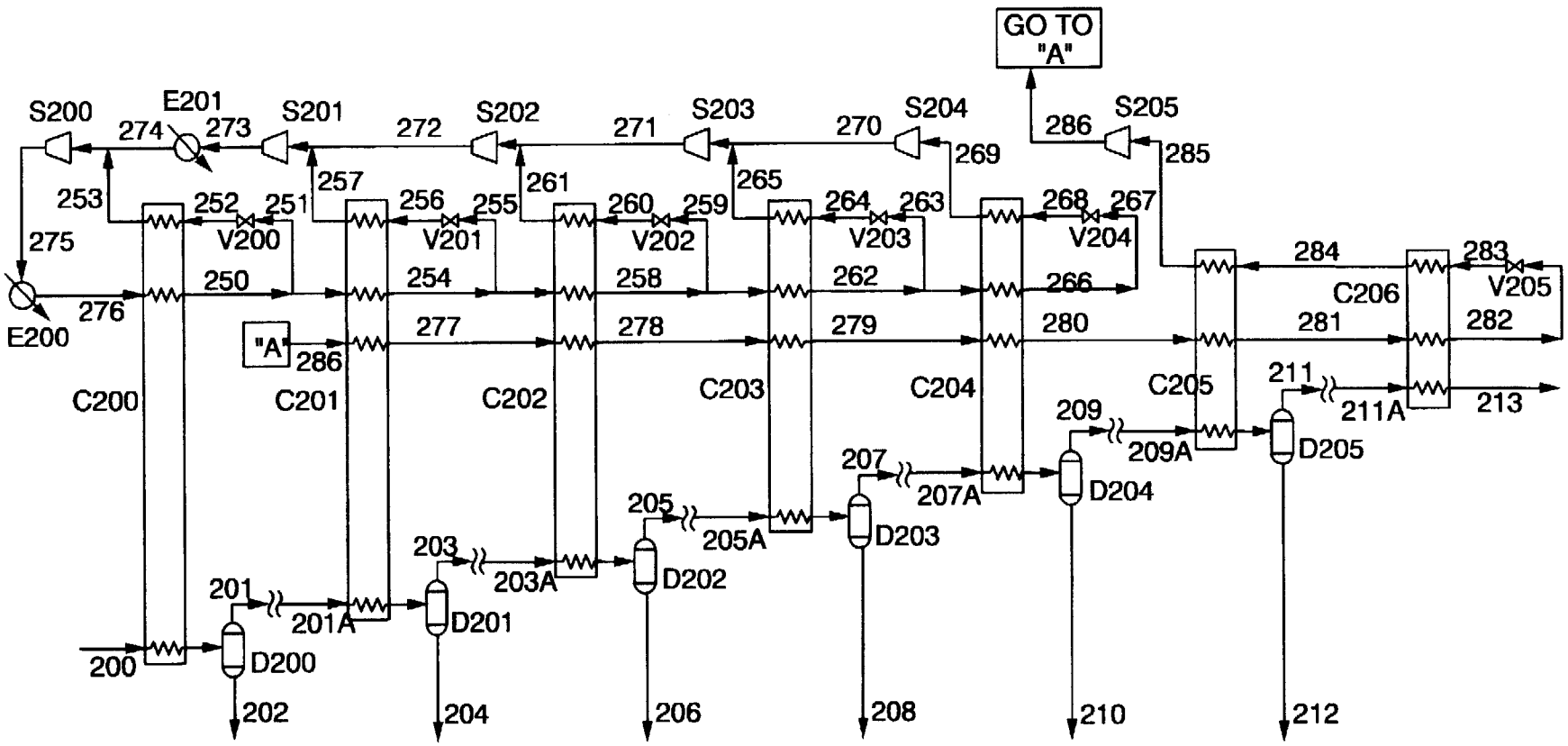
FIG. 2 comprises 2 multi-refrigerant loops, the first multi-refrigerant loop having five compression stages and is substantially similar to that shown in FIG. 1. The second multi-refrigerant loop has a single compression stage and is condensed and subcooled through heat exchange with both the first and second loops.

The process of this Example 2 is generally shown in FIG. 2 and will be referred to as the "FIG. 2 process". As shown in FIG. 1 and further described in this Example 2. Table 2 gives compositions and conditions for the following streams:

| Stream No. | Stream Description |
|---|---|
| 200 | cracked or light olefins-containing gas |
| 201/A | vapor separated from condensation of stream 200 |
| 202 | liquid from condensation of stream 200 |
| 203/A | vapor separated from condensation of stream 201 |
| 204 | liquid from condensation of stream 201 |
| 205/A | vapor separated from condensation of stream 203 |
| 206 | liquid from condensation of stream 203 |
| 207/A | vapor separated from condensation of stream 205 |
| 208 | liquid from condensation of stream 205 |
| 209/A | vapor separated from condensation of stream 207 |
| 210 | liquid from condensation of stream 207 |
| 211/A | vapor separated from condensation of stream 209 |
| 212 | liquid from condensation of stream 209 |
| 213 | partially condensed stream 211 |
| 250,251 | first mixed refrigerant subcooled in multi-stream or platefin exchanger C200 |
| 252 | stream 251 flashed across valve V200 |
| 253 | stream 252 vaporized in multi-stream or platefin exchanger C200 |
| 254,255 | first mixed refrigerant subcooled in multi-stream or platefin exchanger C201 |
| 256 | stream 255 flashed across valve V201 |
| 257 | stream 256 vaporized in multi-stream or platefin exchanger C201 |
| 258,259 | first mixed refrigerant subcooled in multi-stream or platefin exchanger C202 |
| 260 | stream 259 flashed across valve V202 |
| 261 | stream 260 vaporized in multi-stream or platefin exchanger C202 |
| 262,263 | first mixed refrigerant subcooled in multi-stream or platefin exchanger C203 |
| 264 | stream 263 flashed across valve V203 |
| 265 | stream 264 vaporized in multi-stream or platefin exchanger C203 |
| 266,267 | first mixed refrigerant subcooled in multi-stream or platefin exchanger C204 |
| 265 | stream 251 flashed across valve V204 |
| 269 | stream 252 vaporized in multi-stream or platefin exchanger C204 |
| 270 | stream 269 compressed in compression stage S204 |
| 271 | streams 265 and 270 compressed in compression stage S203 |
| 272 | streams 261 and 271 compressed in compression stage S202 |
| 273 | streams 257 and 272 compressed in compression stage S201 |
| 274 | stream 273 cooled in water cooted exchanger E201 |
| 275 | streams 253 and 274 compressed in compression stage S200 |
| 276 | stream 275 condensed in water cooled exchanger E200 |
| 277 | second mixed refrigerant subcooled in multi-stream or platefin exchanger C201 |
| 278 | second mixed refrigerant subcooled in multi-stream or platefin exchanger C202 |
| 279 | second mixed refrigerant subcooled in multi-stream or platefin exchanger C203 |
| 280 | second mixed refrigerant subcooled in multi-stream or platefin exchanger C204 |
| 281 | second mixed refrigerant subcooled in multi-stream or platefin exchanger C205 |
| 282 | second mixed refrigerant subcooled in multi-stream or platefin exchanger C206 |
| 283 | stream 282 flashed across valve V205 |
| 284 | stream 283 partially vaporized in multi-stream or platefin exchanger C206 |
| 285 | stream 284 fully vaporized in multi-stream or platefin exchanger C205 |
| 286 | stream 285 compressed in compression stage S205 |

In FIG. 2, drums D200, D201, D202, D203, D204 and D205 separate the vapor and liquid of streams 200, 201, 203, 205, 207 and 209, respectively, after those streams are partially condensed in multi-stream or platefin exchangers C200, C201, C202, C203, C204, and C205, respectively.

FIG. 2 shows a cascaded multilevel mixed refrigerant process to efficiently increase the temperature range of the mixed refrigerants of the present invention to a lower level. The lower level refrigeration range thereby extends the present invention to condensation (rectification) steps typically found in demethanization of olefins fractionation. A very low temperature cycle with lower boiling mixed refrigerant components is used. A highly efficient second mixed refrigerant consisting substantially of methane and ethylene is used in this embodiment. The condensation and subcooling of the second mixed refrigerant is cascaded to the first mixed refrigerant loop similar to the one described in Example 1, whose heat of compression and heat transferred from the process and subcooling of mixed refrigerant is ultimately rejected to cooling water. The lowest process stream temperature achievable by this embodiment is about −156° F. Generally, two additional multi-stream or platefin exchangers and one more compression stage, stage S205, are required to obtain that result.

The degree of condensation and separation for stream 200, the process gas stream, for the condensation and separation stages associated with multi-stream or platefin exchangers C200, C201, C202, C203 and C204 is substantially the same as that of the FIG. 1 process for the condensation and separation stages associated with multi-stream or platefin exchangers C100, C101, C102, C103 and C104. Two more condensation and separation stages for the process gas stream are made for this FIG. 2 process associated with multi-stream or platefin exchangers C205 and C206. The FIG. 1 and FIG. 2 processes also share first mixed refrigerant composition, pressure and temperature levels of the first mixed refrigerant associated with the first five multi-stream or platefin exchanger condensation and separation stages.

The second mixed refrigerant loop uses a single stage of compression at stage S205 to a pressure of 503 psia. The point of full condensation for the mixed refrigerant is about −91° F. That temperature, −91° F., is also the lowest temperature to which the process gas is cooled by the first mixed refrigerant loop, as for stream 201 for the FIG. 2 process and stream 109 for the FIG. 1 process. The additional two condensation and separation stages cool the process gas stream to −121° F. and −156° F. In those two final condensation and separation stages associated with multi-stream or platefin exchangers C205 and C206, condensed second mixed refrigerant is subcooled to the same temperatures as the process gas streams in a similar manner to that of the first mixed refrigerant in multi-stream or platefin exchangers C200 to C204.

Further describing the second mixed refrigerant loop in FIG. 2, a subcooled second mixed refrigerant stream 282 is flashed across valve V204 from about 500 psia to about 165 psia to form stream 283 at a temperature 5° F. lower than the lowest process temperature desired from the final condensation and separation stage, multi-stream or platefin exchanger C206. The flashed refrigerant stream 283 partially vaporized in multistream or platefin exchanger C206 to form stream 284 and then is completely vaporized in multi-stream or platefin exchanger C205 to form stream 285. The vaporization of the second mixed refrigerant in multi-stream or platefin exchangers C205 and C206 provides cooling for the process gas streams 209 and 211 respectively, and second mixed refrigerant subcooling. The temperature of stream 285, −96° F., is chosen so that its exit temperature from multi-stream or platefin exchanger C205 most closely approaches the temperatures of the process gas stream and second mixed refrigerant exiting multi-stream or platefin exchanger C204.

The compressed, evaporated second mixed refrigerant of stream 286 is sequentially cooled and totally condensed by the first mixed refrigerant by cascaded heat transfer in multi-stream or platefin exchangers C201, C202, C203, and C204. The increase of the duties and flow rates of the first mixed refrigerant in the FIG. 2 process over that of the FIG. 1 process are due to the cooling and condensation of the second mixed refrigerant in multi-stream or platefin exchangers C201, C202, C203 and C204.

Figure 7:
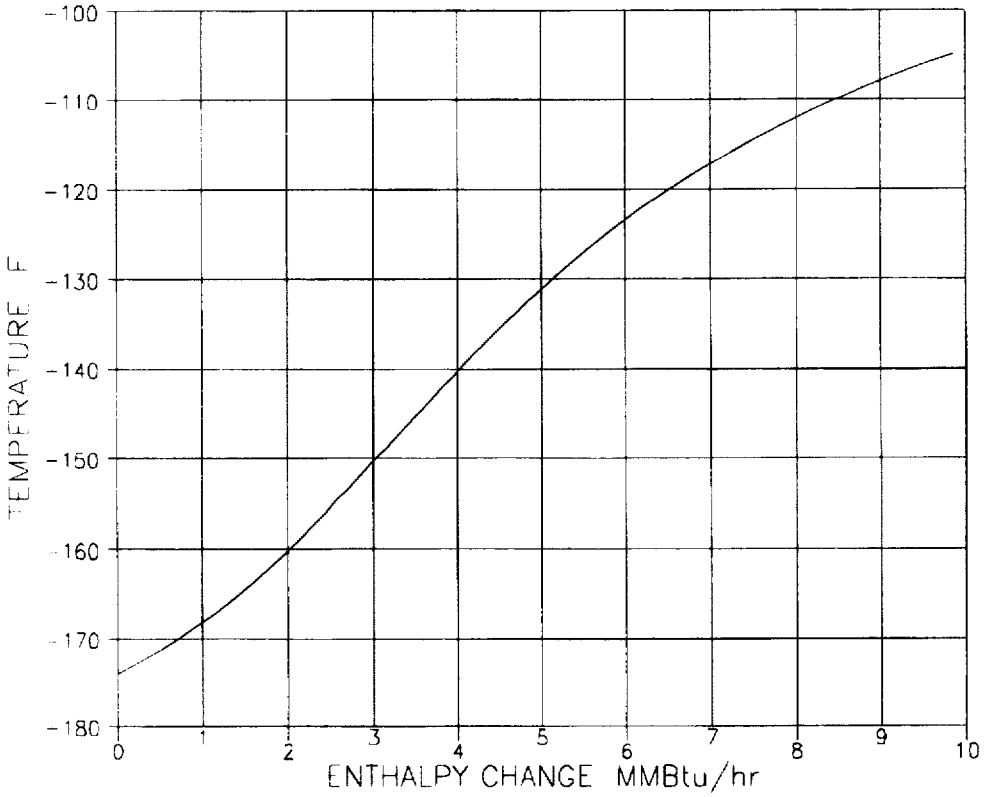

The second mixed refrigerant consists substantially of a mixture of methane and ethylene. The vaporization curve of the second mixed refrigerant, as shown in FIG. 7, is approximately linear.

The cooling curve of the first and second mixed refrigerants might be made more linear through including a component with a boiling point between and methane and ethylene. However, no other relatively inexpensive components are presently available. Without intermediate boiling components between methane and ethylene, some curvature of the vaporization curve is inevitable. However, by careful design this effect may be minimized using only methane and ethylene while avoiding temperature "pinch" points within each heat exchanger.

With the above composition of the second mixed refrigerant, the FIG. 2 process achieves a process gas chilling to about −156° F. at a flashed mixed refrigerant pressure of about 165 psia. It is yet another embodiment of the present invention to add another condensation and separation stage after that associated with multi-stream or platefin exchanger C206. That additional condensation and separation stage is refrigerated by a subcooled portion of the high pressure second mixed refrigerant liquid of the second mixed refrigerant refrigeration loop subcooled to about −215° F. and flashed to a pressure substantially below 165 psia to a temperature of about −220° F.. Because cracked gas derived from ethane or ethane and propane may require such lower temperatures for ethylene recovery and/or high purity hydrogen separation, a second compression stage might be preferred in the second mixed refrigerant refrigeration loop to compress vaporized second mixed refrigerant from substantially below 165 psia to about 165 psia. The compressed vapor from that second compression stage would be combined with the vaporized second mixed refrigerant from multi-stream or platefin exchanger C206 for compression as a mixed stream in stage S205.

The boiling points of methane and ethylene are considerably different. Thus, the temperature range over which the second mixed refrigerant is most efficiently used for a condensation and separation stage should not be reduced below about 65° F. Consequently, multiple compression and pressure levels are preferred for the second mixed refrigerant loop to achieve a very low second mixed refrigerant temperature of about −220° F. Such additional compression stages in association with additional condensation and separation stages would be advantageous is a cracked gas derived from ethane or ethane and propane were desired to be processes.

Figure 3:
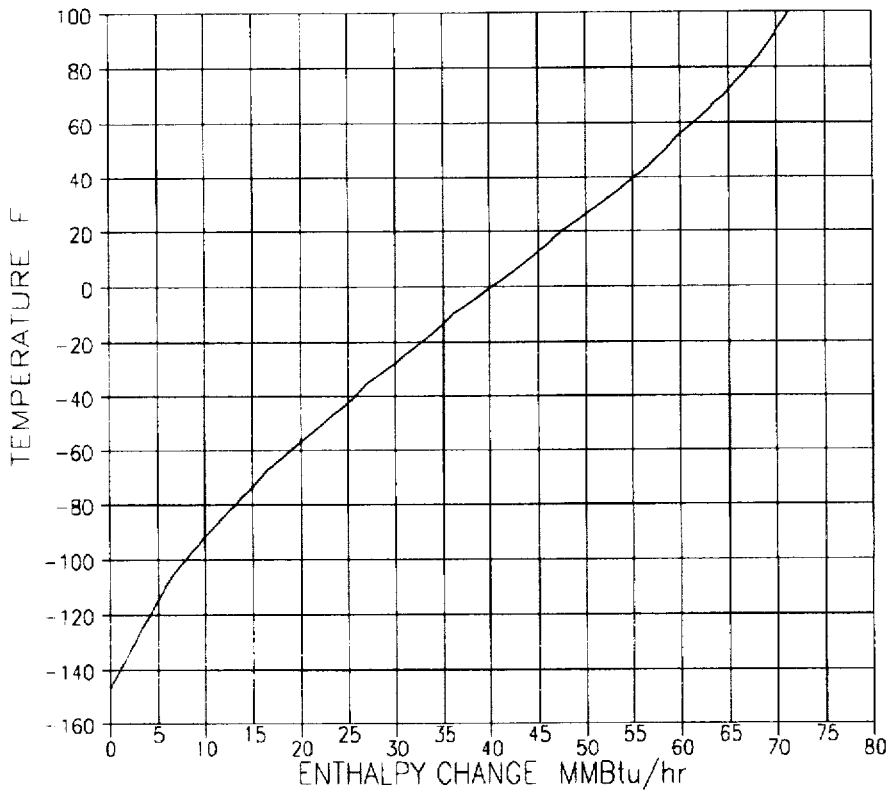
FIG. 3 is a cooling curve for the condensation of components from a pyrolized or cracked gas, as is typical of an olefins or ethylene recovery by fractionation.

Example 3—Comparison of Multilevel Mixed Refrigeration with Conventional Cascade Refrigeration FIG. 3 shows a typical cooling curve for the condensation of ethylene and associated components from a compressed process gas derived from pyrolyzing petroleum naphtha. The process of the present invention in the above examples has been scaled to produce approximately one billion pounds of ethylene per year. No distillation or multi-stage fractionation has been included in the process evaluated in the cooling curve of FIG. 3, so the condensation curve is relatively smooth. About 71 MMBtu/hr must be removed from the process and the minimum temperature is about −147° F. which may be achieved with a conventional propylene ethylene cascade refrigeration process.

The improved efficiency and performance of the FIG. 2 process is considered in Table 3 and to a significant degree is due to the identification of a mixed refrigerant whose vaporization curve closely matches the cooling curve of the process gas stream. In Table 3, the column titled "Cascade E/P" represents a condensation process displayed in FIG. 4, wherein an ethylene refrigeration loop cascades its process heat and compression energy transfer to an propylene refrigeration loop. Also in Table 3, the column titled "Cascade MLMR" represents the FIG. 2 process. The column titled "Ratio" is the percentage of the appropriate quantity for the FIG. 2 process as compared to the FIG. 4 process. Compressor power for the FIG. 2 process is only 85% of that of the FIG. 4 process. Compressor suction volumetric flow is reduced to 47% of that of the FIG. 4 process. Such reduction translates into dramatic reduction in compressor capital cost. Heat exchange is slightly higher for the FIG. 2 process as compared to the FIG. 4 process. Cooling water and pump horsepower for the FIG. 2 process are less than one third of that of the FIG. 4 process.

Figure 4:
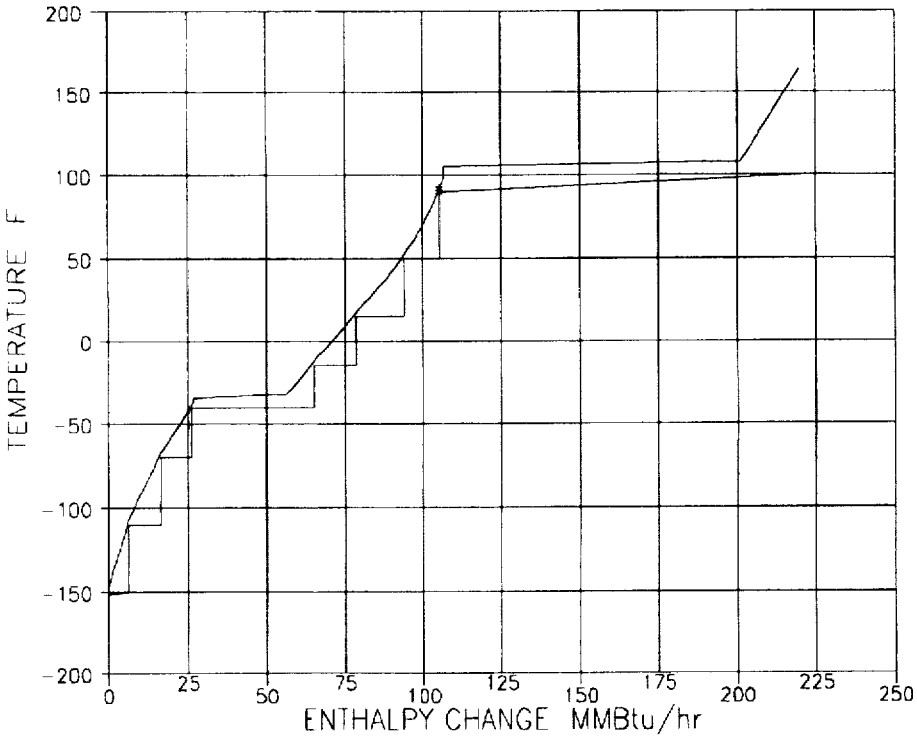
FIG. 4 shows the comparative vaporization and condensation curves of propylene/ethylene refrigerants and cracked gas, respectively, as used in the prior art to recover the desired components of that cracked gas.

FIG. 4 shows the composite heating and cooling curves for a conventional propylene I ethylene cascade refrigeration process which has been designed to provide the cooling necessary to achieve the condensation shown in FIG. 3. The process cooling curve from FIG. 3 is included in the FIG. 4 composites. Three stages of ethylene refrigeration from −150° F. to −70° F. and four stages of propylene refrigeration from −40° F. to 50° F. have been used in the FIG. 4 process. The plateau at about −40° F. shows the transfer of heat from the ethylene cascade to the propylene cascade. The plateau at about 100° F. shows the transfer of heat from the propylene cascade to cooling water. Because of the flat condensing curve for propylene at about 105° F. a temperature rise of only 10° F. from 90° F. to 100° F. may be used for the cooling water.

In FIG. 4, it is evident that there are large and thermodynamically inefficient temperature driving forces because of the mismatch of the sloping process cooling curve with the flat vaporization curves of the pure component refrigerant. The significant thermodynamic inefficiencies due to the flash vaporization of saturated liquids through the refrigeration valves is not evident in FIG. 4.

In actual operation, the mixed refrigerant compressor stages must be adaptable to changes in load and/or process stream composition. The skilled person is familiar with single and multiple compression stage bypasses and driver speed controls to accommodate the difference in compression stage loads where the compression stages share a common driver. Accommodation may also be achieved by adjustment of relative amounts of the components of the mixed refrigerants while retaining a compressor designed for condensing a very different process gas stream.

It is an additional and important embodiment of the present invention to effect more than one condensation and separation of process gases of different compositions at the condensation and separation stages shown in the processes of FIGS. 1 and 2. Parallel and/or sequential combined with parallel condensation and separation stages may be advantageously refrigerated with the mixed refrigerants refrigerating only one condensation and separation stage of the FIG. 1 and FIG. 2 processes. As the complexity of applying the present invention to a fractionation sequence increases, such parallel or sequential combined with parallel condensation and separation stages will become a necessity. In addition, it is known and required of current economical refrigeration of olefins fractionation sequences to recover the refrigeration applied to process streams through cooling of warmer process and/or refrigeration streams through heat transfer from cold process streams. Typically, hydrogen, hydrogen/methane, methane, ethylene and ethane streams after desired separation is achieved, are heated with process and/or refrigerant streams. Thus, the present invention includes recovery of refrigeration duty from process streams back to the condensation and/or subcooling of the mixed refrigerants.

Figure 5:
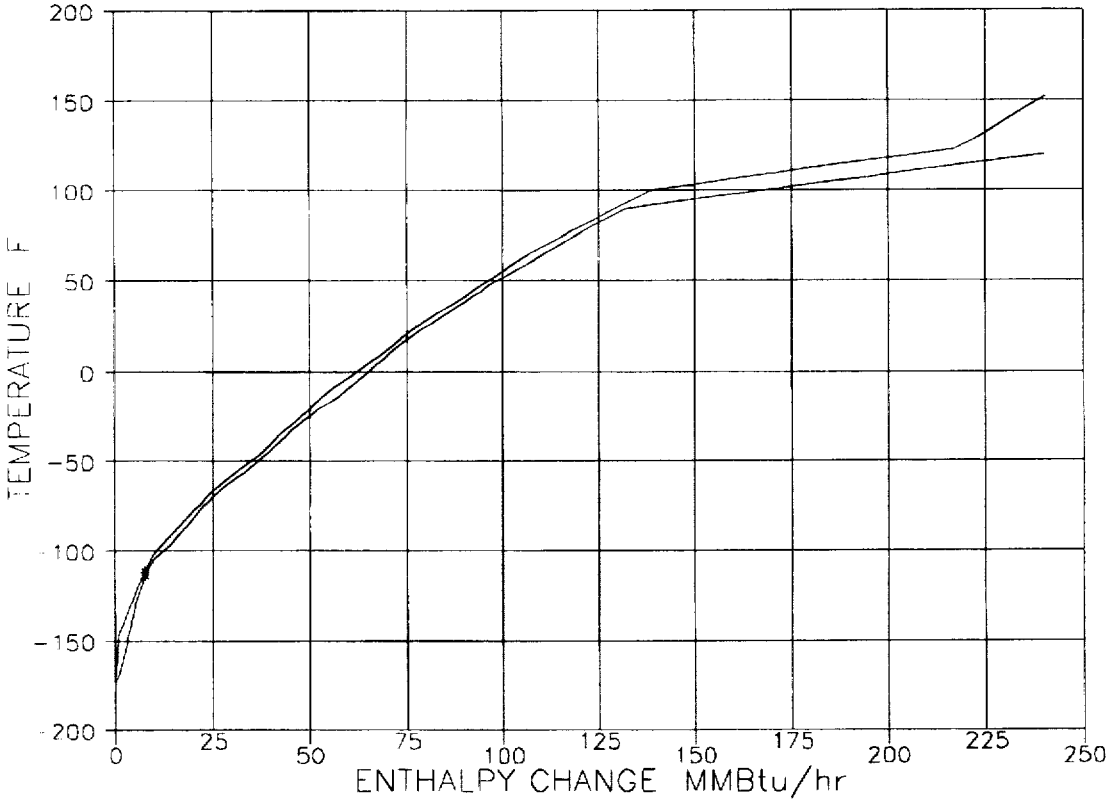
FIG. 5 shows the comparative vaporization and condensation curves of the mixed refrigerants of the present invention and cracked gas, respectively, for the process described in Example 2 below.

FIG. 5 shows the coninuously close approach temperatures achieved by the process of the present invention. Cooling of the mixed refrigerant streams by cooling water to about 100° F. represents a significant improvement of the present invention over the prior art. The continuously closely coupled approach temperatures of the cooling water to the process streams shown in FIG. 5 represents a significant reduction in cooling water requirements for the process as a whole. FIGS. 6 and 7 are vaporization curves for the high level and low level mixed refrigerants respectively and show smoothly continuous, relatively linear curves. When considering adding or removing components from the mixed refrigerants or changing the relative compositions of those components, the vaporization curve of the mixture may be compared with the cooling curve of the process streams to guide the process designer to a more optimal choice for mixed refrigerant components or relative compositions.

Figure 8:
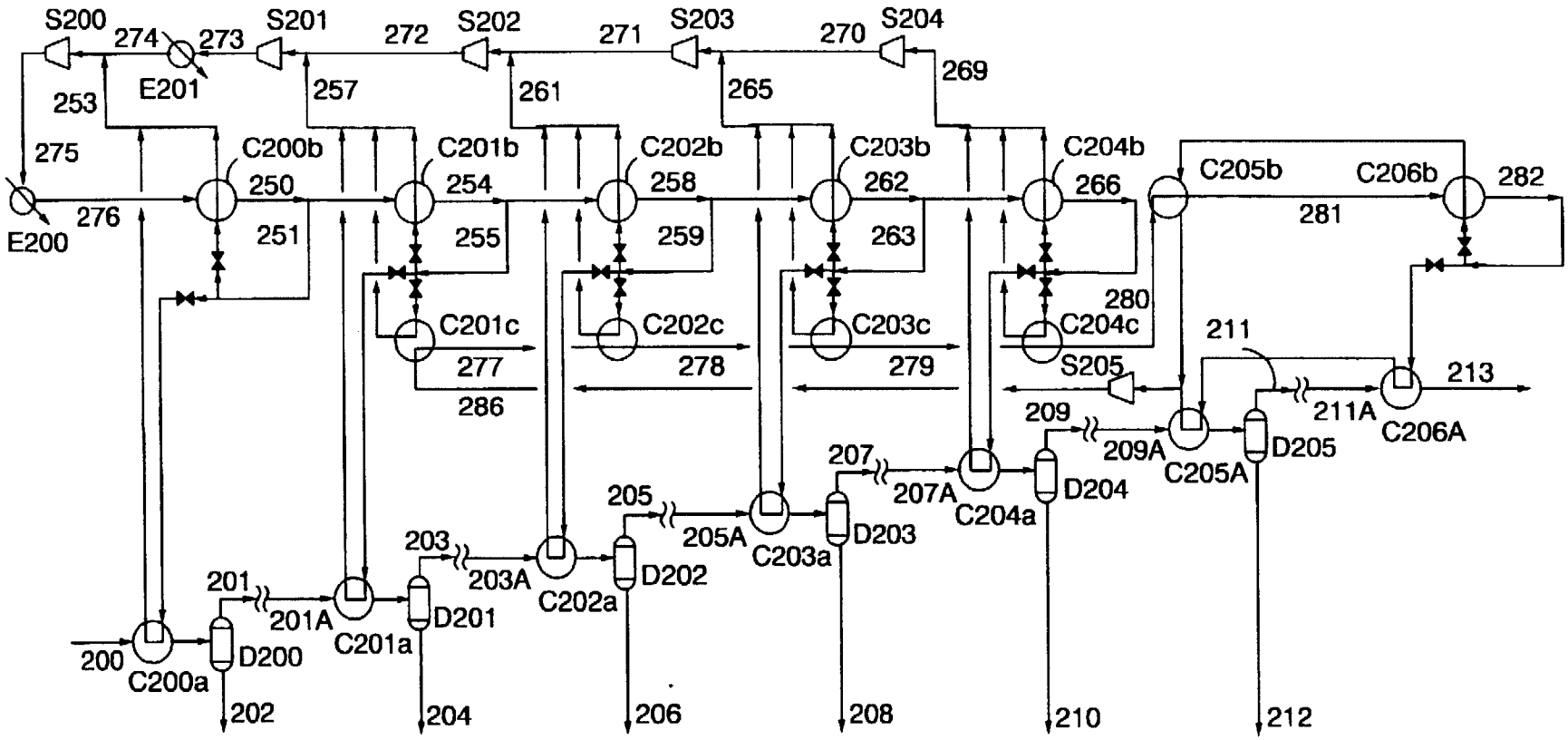
FIG. 8 shows the FIG. 2 process wherein platefin or mulistream heat exchangers are replaced with heat transfer devices wherein only two streams indirectly transfer heat to each other.

FIG. 8 shows the process of the present invention of this example with single stage heat transfers (preferably within a single pressure shell) in contrast to the multi-stream, multi-stage heat exchangers previously discussed. It is not a limitation of the present invention that such multi-stream exchangers are indicated as preferred in the above discussion. The relative increase in cost for separate heat transfer stages as shown in FIG. 8 over multi-stream exchangers are not a limitation to obtaining the thermodynamic efficiencies of the present invention.

Example 4—Application of the Multilevel Mixed Refrigeration Invention to a Ethylene Recovery Fractionation Sequence Another example of the present invention is now described with reference to FIGS. 9, 10 and 10A. With respect to FIG. 10, the item and stream numbers for a high level mixed refrigerant loop are the same as those shown in FIG. 2, and are intended to have substantially the same function as those same-numbered items and streams, although the conditions and compositions of those streams are shown in Table 4 below.

Figure 9:
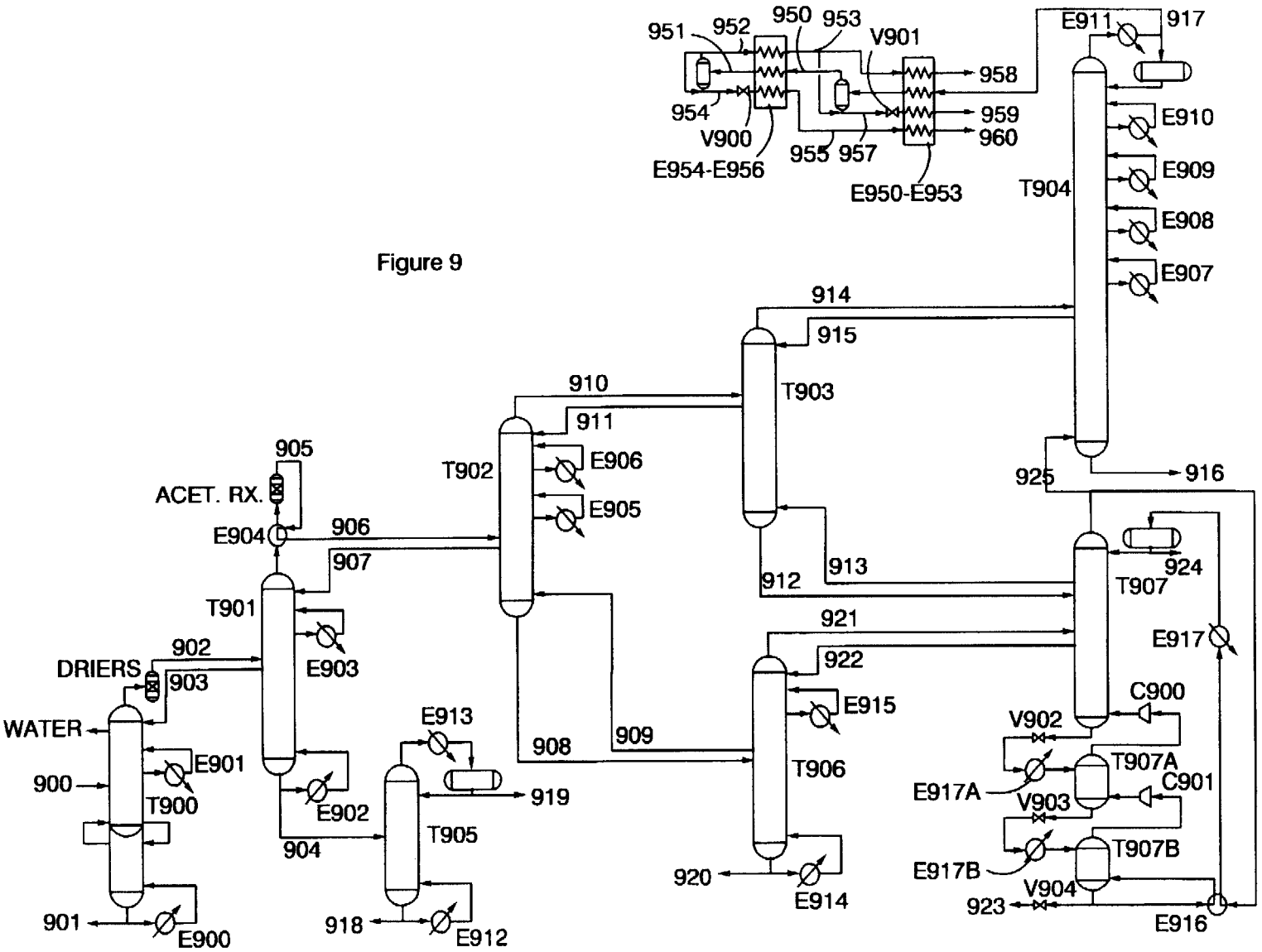
FIG. 9 shows a distributed fractionation sequence for compressed pyrolyzed naphtha.

FIG. 9 is generally a flow diagram for an ethylene recovery process using distributed distillation, recycle coupling, and thermomechanical integration. The mixed refrigeration systems of the present invention are not shown in FIG. 9, but are shown separately in FIGS. 10 and 10A. The streams, stream conditions and compositions and duties of the heat exchange steps are shown in Table 4 for this entirely integrated process. It is believed that further optimization of the process of this example will be possible to improve thermodynamic and/or reduce capital cost, although the present example represents a preferred application of the mixed refrigeration invention.

The feed stream, stream 900, in FIG. 9 is typical for short residence time pyrolysis of petroleum naphtha. Upstream processing of stream 900 occurs as follows. A four stage intercooled cracked gas compressor compresses the feed to 268.4 psia and 100° F. Interstage flashbacks partially separate the heavier gasoline components and feed a low pressure stripper which strips C3 and lighter components back into the first compressor stage suction. The gases from the third stage separation drum are treated to remove acid gases (H20 and C02). The fourth stage discharge pressure is significantly lower than conventional fractionation sequences for ethylene. It is preferable to maintain this low fourth stage discharge pressure to avoid reboiler fouling in the a separation column in FIG. 9, the C3's distributor column, column T901.

The fractionation columns in this process comprise theoretical separation stages numbered sequentially from top to bottom. The first column in the separation process, T900, is a C4's distributor which separates C3's and lighter components from its bottoms product and C5's and heavier components from its overhead product. To avoid high reboiler temperatures the stripping section is multipressure, as shown in FIG. 9 by the separation created by an intermediate bottom column head (valves and/or compression steps are not shown for the interchange of streams between the higher pressure upper shell and the lower pressure lower shell).

Column T900 has 34 stages, has a partial intercondenser, E901, with vapor sidedraw and partially condensed return stages numbering 14 and 9, using the highest level of mixed refrigeration of the high level mixed refrigerants at about 60° F. Although shown but not having a label in FIG. 9, the column vapor sidedraw streams to partial intercondenser exchangers E901, E903, E905–E910 and E915 and the vapor overhead stream of column T904 to exchanger E911 are named streams SE901, SE903, SE905–SE910, SE915 and SE911 respectively. The conditions and compositions of streams SE901, SE903, SE905–SE910 and SE915 are shown in Table 4.

Figure 10:
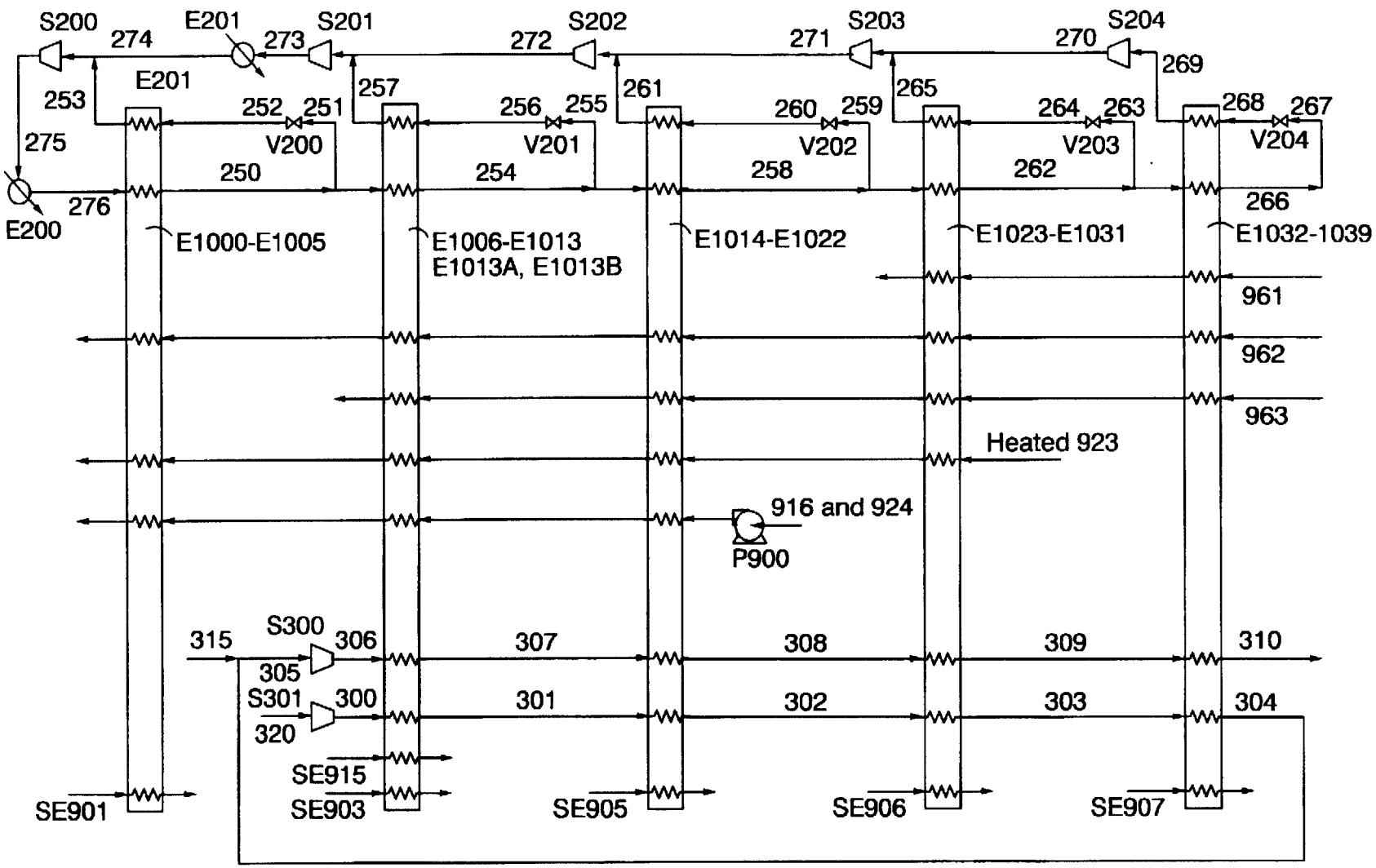
FIG. 10 shows a portion of the multi-level mixed refrigeration of the present invention as applied to the process shown in FIG. 9.
Figure 10A:
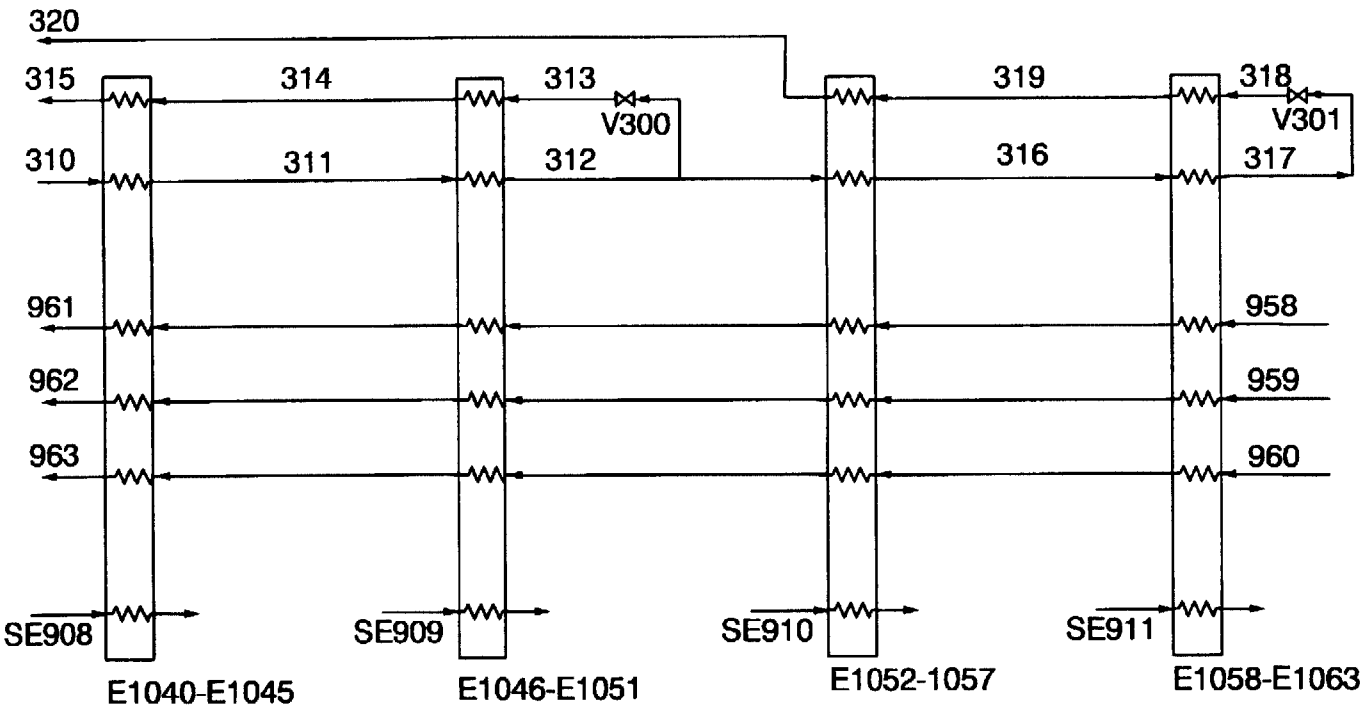
FIG. 10A shows the remaining portion of the multi-level mixed refrigeration of the present invention, shown in part in FIG. 10, as applied to the process shown in FIG. 9.

With reference to FIGS. 10 and 10A, the term "levels of refrigeration" refer to multistream heat exchange stages E1000–E1005, E1006–1013/1013A/1013B, E1014–E1022, E1023–E1031, E1032–E1039, E1040–E1045, E1046–E1051, E1052–E1057 and E1058–E1063 corresponding to the first through fifth levels of refrigeration for the high level mixed refrigerants and first through fourth levels of refrigeration for the low level mixed refrigerants respectively. Each of these stages provide a level of refrigeration to the process of the present invention through an optimized temperature range, including refrigeration recovery from process streams. In FIGS. 10 and 10A, the name of each stage is an indication of a sequence of numbers matching the exchanger item numbers in Table 4, such that the lowest number in the sequence is represented in their drawing of the stage as the short, vertically zigzagged line highest in the stage, the next highest number in the sequence is represented by the next lowest short, vertically zigzagged line, and so on. In addition, it will be apparent to the skilled person from the stream conditions and compositions in comparison to the Figures where heat exchange will be taking place. Streams shown in FIGS. 10 and 10A flowing from right to left as they pass through the refrigeration stages are being heated. Streams shown in those Figures flowing from left to right as they pass through the refrigeration stages are being cooled.

Column T900 produces a bottoms product stream 901 and is reboiled through exchanger E900. Column T900 produces an overhead stream 902 (fed to stage 19 of 38 stage column T901) and is refluxed using a liquid sidedraw stream 903 from stage 17 from downstream column T901 (recycle coupling) so that no overhead condenser is needed. The stream 900 contains water so a water sidedraw (the stream WATER in FIG. 9) is necessary, and the overhead product is completely dried in the DRIER shown in FIG. 9.

Column T901 is a C3's distributor which separates C2's and lighter from the bottoms product and C4's from the overhead product. The bottoms product, stream 904, feeds a depropanizer, column T905 (38 stages), which is shown as significant to the fractionation sequence but has no interaction with the mixed refrigeration system of the present invention since no refrigeration is required other than cooling water. Column T905 is refluxed through exchanger E913, reboiled through exchanger E912 and produces an overhead liquid stream 919.

Column T901 has a partial intercondenser, exchanger E903 (sidedraw stage 17, return stage 9), using the second level of mixed refrigeration for the high level mixed refrigerants at about 25° F. Column T901 produces an overhead stream 906 and is refluxed using a liquid sidedraw stream 907 from stage 19 of downstream column T902 (39 stages) (recycle coupling) so that no overhead condenser is needed. The overhead stream 905 is heated in a feed/effluent exchanger E904, hydrogenated to remove acetylene and some MAPD, recooled to form stream 906 and fed to stage 19 of column T902

Column T902 is a C2's distributor column which separates methane to overhead stream 910 from the bottoms product stream 908 and additionally separates C3's to stream 908 from stream 910. Two partial intercondensers, E905 (sidedraw stage 18, return stage 13) and E906 (sidedraw stage 13, return stage 8), respectively use the third and fourth levels of mixed refrigeration of the high level mixed refrigerants at about −18° F. and about −54° F. Column T902 is refluxed with stream 911 from stage 49 of downstream column T903 (69 stages) and is reboiled with stream 909 from 19 downstream column T906 (53 stages) (recycle coupling) so no condenser or reboiler are needed. Bottoms stream 908 is fed to stage 19 of column T906.

Deethanizer column T906 separates C2's to overhead stream 921 and C3's to the bottoms stream 920. Column T906 is reboiled through exchanger E914 and has a partial intercondenser, E915 (sidedraw stage 19, return stage 9), which uses second level refrigeration of the high level mixed refrigerants at about −25° F. The deethanizer is refluxed with stream 922 from stage 79 downstream column T907 (108 stages) (recycle coupling) so no condenser is needed. The deethanizer bottoms stream 920 is combined with the depropanizer overhead stream 919, hydrogenated, and feeds the C3 splitter column (not shown).

Column T903 is an ethylene distributor column which separates methane to overhead stream 914 and ethane to bottoms stream 912. There is no intercondenser on column T903. Column T903 is refluxed with stream 915 from stage 29 of column T904 (49 stages) and is reboiled with stream 913 from stage 74 of column T907 (recycle coupling) so neither a condenser or reboiler are needed. Bottom stream 912 is fed to stage 74 of column T907.

Column T904 is a demethanizer and has four partial intercondensers, E907 (sidedraw stage 29, return stage 24), E908 (sidedraw stage 24, return stage 19), E909 (sidedraw stage 19, return stage 14), and E909 (sidedraw stage 14, return stage 9) and a condenser, exchanger E910. Exchanger E907 uses the fifth level of mixed refrigeration of the high level mixed refrigerants at about −103° F. Exchangers E909 and E908 sequentially use the level of mixed refrigeration of the low level mixed refrigerants at about −158° F. Exchangers E910 and E911 sequentially use the second level of mixed refrigeration of the low level mixed refrigerants at about −230° F. The first and second levels of mixed refrigerants of the low level mixed refrigerants are a separate low temperature refrigeration cycle, as further described below.

The several intercondensers for column T904 are preferred to achieve sufficient mass transfer in the demethanizer. A dephlegmator could replace several top stages and the intercondensers of column T904 as an alternative. The demethanizer is reboiled with stream 925, a portion of the overhead vapor stream from column T907, so no reboiler is needed.

Column T907 is a thermomechanically integrated C2 splitter using two compressors C900 and C901 to recompress vapor overhead streams from sequentially reduced pressure lower columns T907A and T907B. At least a part of, but preferably all of the condensing refrigeration for column T907 (which is then cascaded to columns T907A and T907B) is provided by process heat transfer in exchangers E917, E917A and E917B. In exchanger E917 stream 923 is heated to form "Heated Stream 923" and then sent to stage E1014–E1022 for further recovery of process refrigeration. Consequently, the refrigeration for C2 splitting does not directly affect the operation of the mixed refrigeration for the fractionation sequence of the present invention, although optimimization of process heat recovery to the mixed refrigeration loops reduces total utility requirements. The ethylene (streams 916, 924, which are combined and pumped in liquid state to typical pipeline pressure in pump P900, shown in FIG. 10) and ethane (Heated Stream 923) products, however, do provide refrigeration to the mixed refrigeration of the high level mixed refrigerants.

The stream 917 feeds a conventional two drum hydrogen recovery system with hydrogen bleedback on both methane products. Although many times a one drum process is preferred, the relatively low pressure of the fractionation sequence of the present invention (about 212 psia) is preferred for this example. Some additional product stream compression is preferred. The hydrogen and methane products provide cooling as they are heated back to ambient temperature. The designation of multi-stream heat exchange stages E950–E953 and E954–E956 corresponds to the same system of applying sequentially downward increasing designations to the heat transfer steps as described above for FIGS. 10 and 10A, except that in FIG. 9, streams flowing from right to left are being cooled and streams flowing left to right are being heated. Stream 917 is partially condensed at exchanger E951 in stage E950–E953, whereby the liquid and vapor phases are separated in a drum, the separated vapor portion being stream 950. Stream 950 is partially condensed in exchanger E955 in stage E954–E956, whereby the liquid and vapor phases are separated in a second drum. A part of the separated vapor portion is stream 952. The liquid portion from the second drum is combined with a part of the vapor portion from that drum to form stream 954 and is then flashed across valve V900, which with stream 952, provide refrigeration to the two multi-stream heat exchanger stages. A part of the vapor from the second drum is mixed with the liquid from the first drum and flashed across valve V901 to provide additional refrigeration to stage E950–E953. The hydrogen product stream 958, first drum hydrogen-methane stream 959 and second drum hydrogen-methane stream 960 are brought to stage E1058–E1063 as shown in FIG. 10A and pass countercurrently and sequentially through the stages shown in FIG. 10A to become streams 961, 962 and 963 respectively. Streams 961, 962 and 963 appear in FIG. 10 and contribute process refrigeration to the stages indicated therein at the rates shown in Table 4.

Figure 9A:
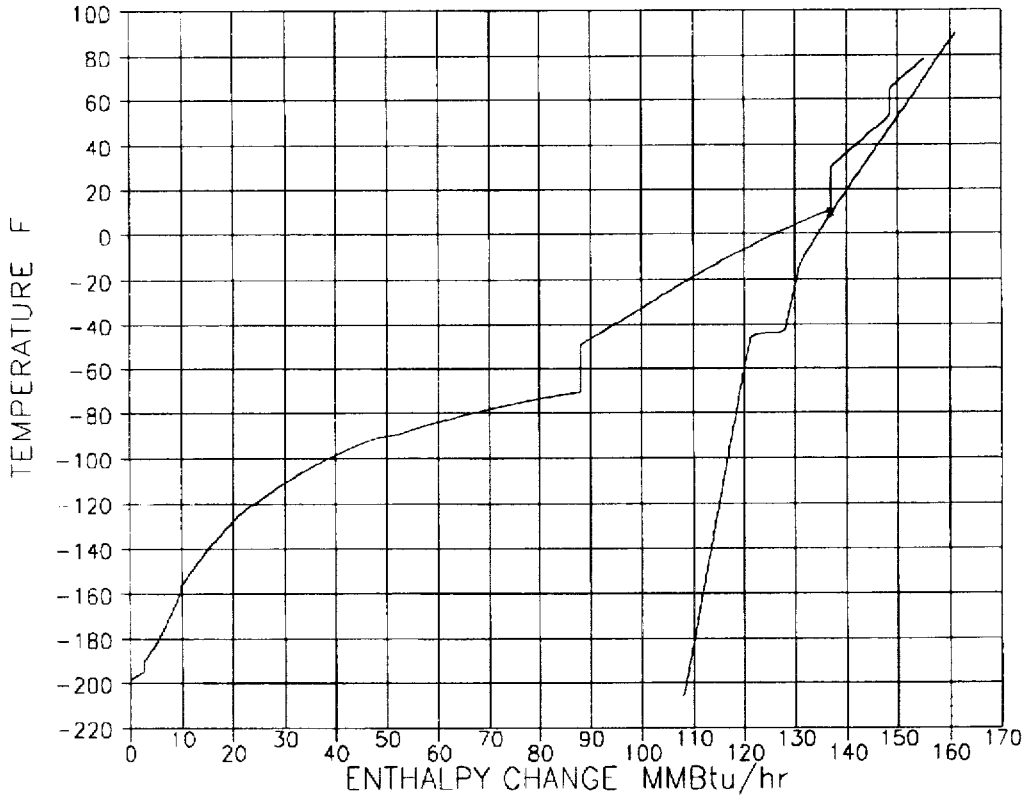
FIG. 9A shows composite heating and cooling curves for the ethylene recovery process according to the use of the multi-level mixed refrigeration of the present invention.

FIG. 9A shows composite heating and cooling curves for the ethylene recovery process except that the hydrogen recovery, thermomechanically integrated C2 splitter, and acetylene reactor heat exchange systems have been omitted. These systems are independently heat balanced and require no additional refrigeration. The plateau at about −195° F. in the cooling curve is the demethanizer condenser and the cooling curve would be smoothed out if a dephlegmator were used. The plateau at about 45° F. in the heating curve is from vaporizing ethane product, and the size of this plateau will depend somewhat on the C2 splitter heat balance system since part of the ethane product is vaporized to balance that system.

Figure 9B:
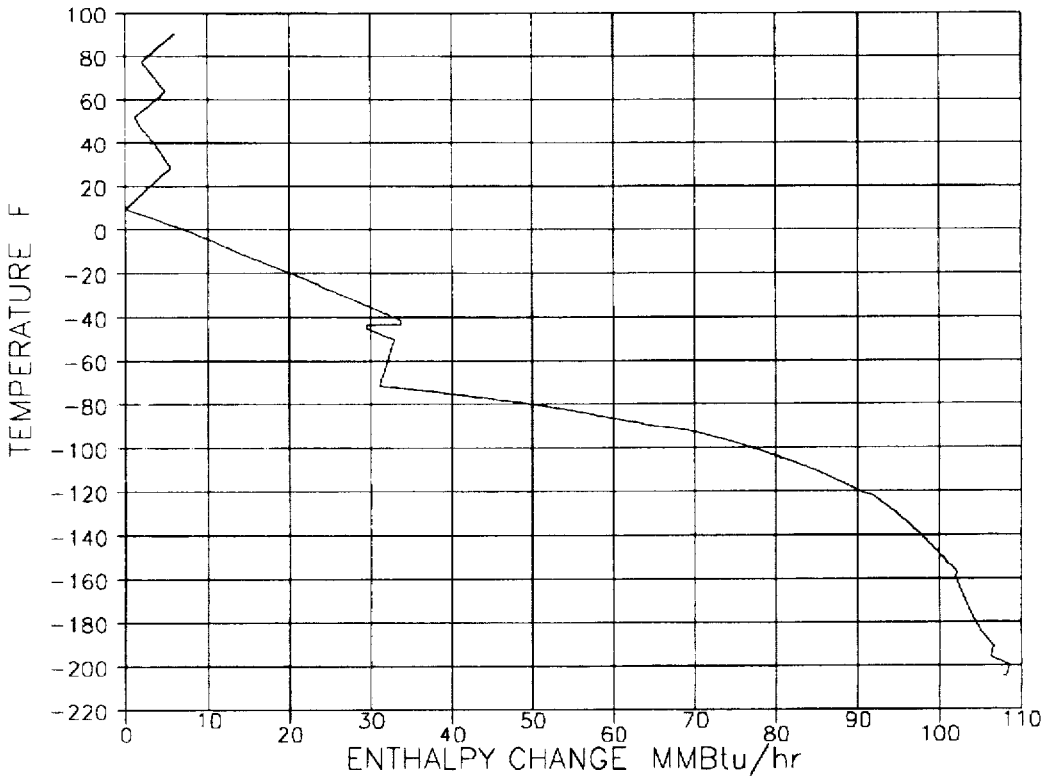
FIG. 9B shows the grand composite cooling curve corresponding to the FIG. 9A composite heating and cooling curves.

FIG. 9B shows the grand composite cooling curve corresponding to the FIG. 9A composite heating and cooling curves. The vertical step from about 40° F. to about −70° F. is due to the rectifying section of the ethylene distributor which has no intercondenser. This step generates the energy penalty for fractionating approximately one half of the ethylene from ethane and greatly reduces the C2 splitter size and duties.

Figure 9C:
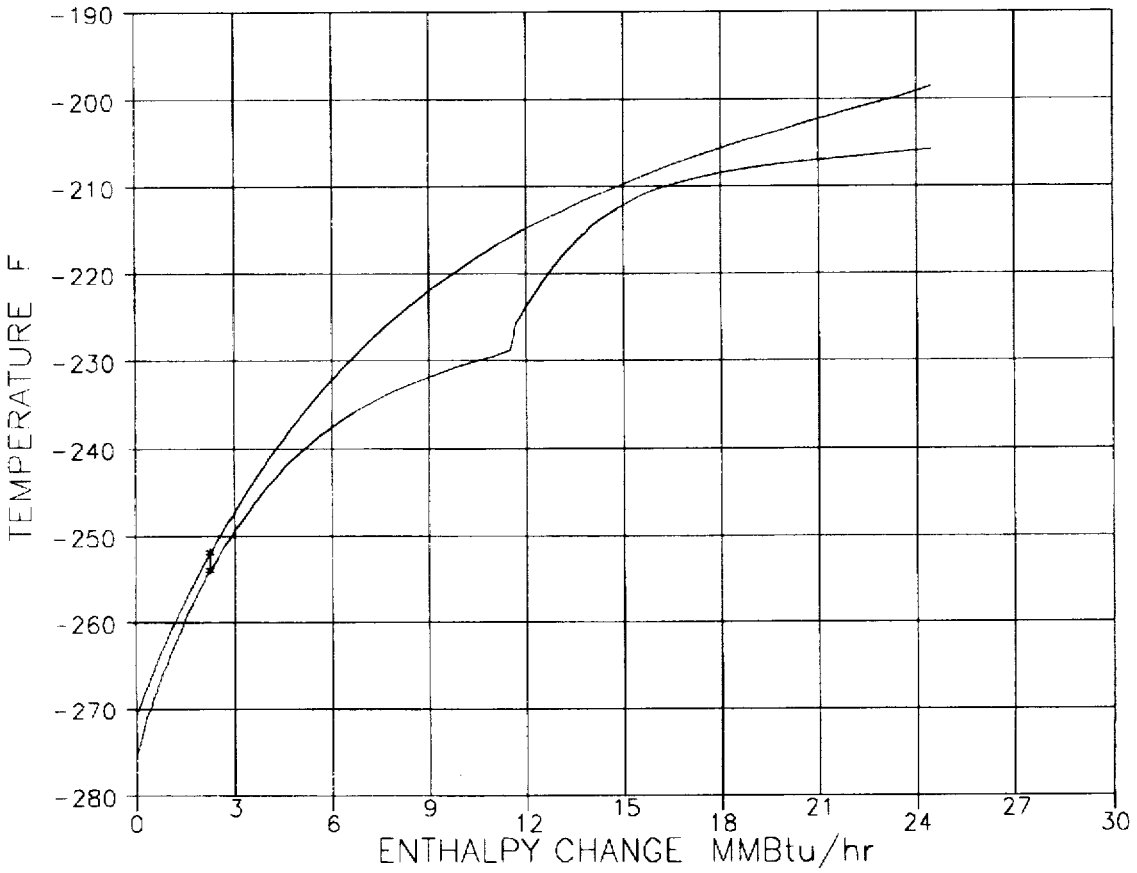
FIG. 9C shows the composite heating and cooling curves for the two drum hydrogen recovery system.

FIG. 9C shows the composite heating and cooling curves for the two drum hydrogen recovery system. FIG. 9B shows the grand composite cooling curve corresponding to the FIG. 9A composite heating and cooling curves. About 67% of the hydrogen in stream 900 is recovered at 95 mole percent purity.

FIGS. 10 and 10A show a two level low temperature mixed refrigerant cycle providing cooling for the top portion of the demethanizer rectifying section. The demethanizer condenser and the three partial intercondensers are identified in FIG. 9 and the intercondenser sidedraw streams conditions and compositions are shown in Table 4. In general, any of the heat exchange steps identified in this Example 4 may be accomplished independent of the multi-stream heat exchanger stages shown in FIGS. 9, 10 and 10A. It may be preferable, however, to combine mechanically into one plate-fin exchanger the two highest and two lowest temperature process refrigeration steps to avoid having to redistribute the mixed phase flows.

Alternatively, it could be preferable that the top section of the demethanizer rectifying section comprises dephlegmator using two mixed refrigerant levels. However, in the present example, the highest temperature partial intercondenser in the rectifying section of the demethanizer is serviced by the lowest level of the high temperature mixed refrigerant cycle.

The low pressure low level mixed refrigerant stream 320 is compressed in compressor stage S301 to form streams 300, 301, 302, and 303 which are desuperheated in exchangers E1013, E1021, E1030 and E1038 respectively and sequentially to form stream 304. Stream 304 is combined with high pressure low level mixed refrigerant stream 315 to form stream 305, which is compressed in compressor stage S300 to form stream 306. Streams 306, 307, 308 and 309 desuperheated and condensed in exchangers E1012, E1020, E1029 and E1037 respectively and sequentially to form stream 310. Stream 310 shown on FIG. 10 continues on FIG. 10A as being then subcooled in exchangers E1041 and E1047 to form stream 311, a portion of which is flashed across valve V300 to form stream 313. Stream 313 provides refrigeration sequentially in exchangers E1046 and E1040 to form stream 315, which stream continues to stream 315 in FIG. 10.

A remaining portion of stream 311 is further subcooled sequentially in exchangers E1053 and E1059 to form streams 316 and 317. Stream 317 is flashed across valve V301 for form stream 318. Stream 318 provides refrigeration sequentially in exchangers E1058 and E1052 to form streams 319 and 320, from which stream 320 continues to stream 320 in FIG. 10. In FIG. 10A, process streams are refrigerated in exchangers E1045, E1051, E1057 and E1063.

For the high level mixed refrigerant cycle, shown substantially in FIG. 10, subcooling is provided for streams 276, 250, 254, 258 and 262 are provided in exchangers E1001, E1007, E1015, E1024 and E1033. Refrigeration to the multi-stream heat exchanger stages are provided with flashed streams 268, 264, 260, 256 and 252 in exchangers E1032, E1023, E1014, E1006 and E1000. Water cooled exchangers E200 and E201 provide the only external cooling utilities for the refrigerant cycles.

Figure 10B:
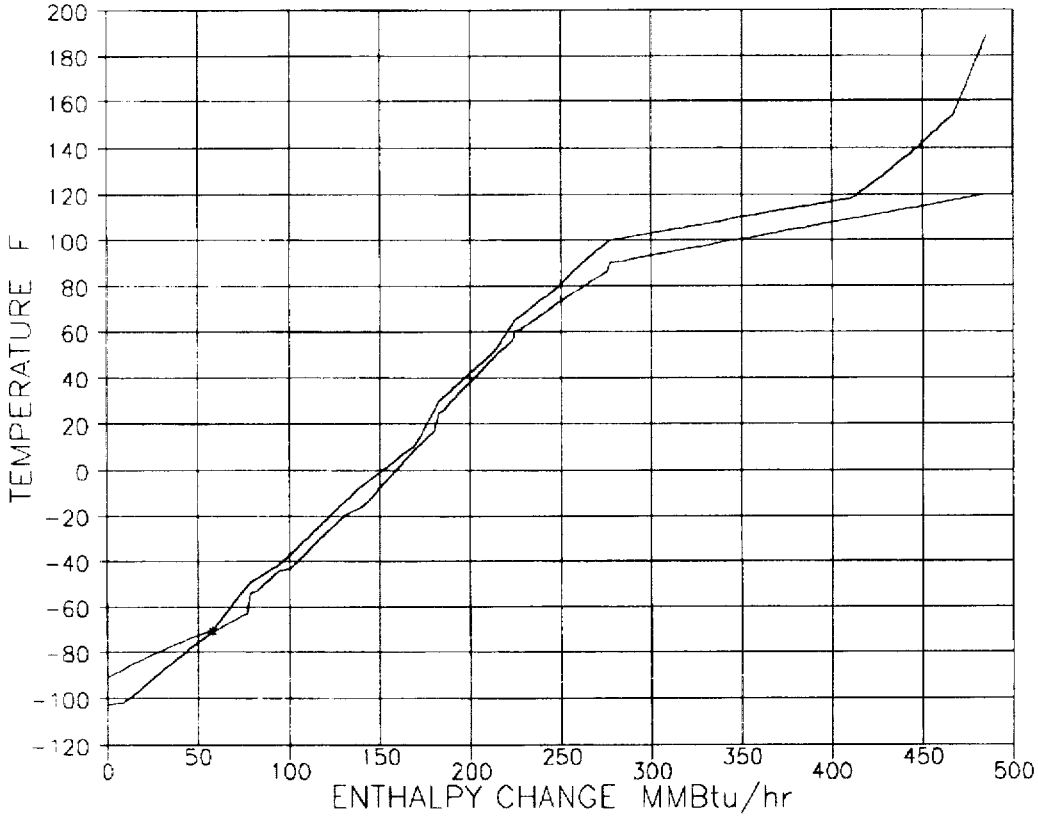
FIG. 10B shows the composite heating and cooling curves for the process and low temperature mixed refrigerant cycle between −89° F. and −230° F.

FIG. 10B shows the composite heating and cooling curves for the process and low temperature mixed refrigerant cycle between −89° F. and −230° F. Each of the four heat exchange systems in the two level system is independently heat balanced. The plateau in the cooling curve at −195° F. is the demethanizer condenser. The small plateaus in the heating curve at about −230° F., −205° F., −165° F., 158° F., and −94° F. are due to a failure in a simulation algorithm to properly distribute the pressure drop through a two phase heater. This failure makes the pinch point look somewhat tighter than it is in reality.

The high level mixed refrigerant composition has been modified slightly in comparison with the compositions of the other examples herein so that a smaller temperature span (about 5° F. less) is used at each refrigerant level. In addition the water cooled condenser pressure of 581 psia is higher, and the lowest level refrigeration temperature in stream 103° F. is lower. This allows the high temperature mixed refrigerant process to better accommodate the thermodynamic pinches caused by the steps in the ethylene process grand composite cooling curve shown in FIG. 9B.

However, in addition to the small composition change described above, the pressures on the lowest and middle temperature levels have been dropped somewhat to accommodate the thermodynamic pinches. As a result the evaporator outlets are now somewhat superheated. This would represent typical operational adjustments to changing process requirements and only moderately reduces the efficiency of the cycle. The efficiency reduction could be recovered by readjustment of the mixed refrigerant composition and reoptimizing the mixed refrigerant temperature levels.

The high level mixed refrigerant process supplies refrigeration for the C4's distributor partial intercondenser, the C3's distributor partial intercondenser, the deethanizer partial intercondenser, the two C2's distributor partial intercondensers, and the bottom partial intercondenser in the demethanizer. It also supplies refrigeration for desuperheating the low temperature mixed refrigerant cycle low level compressor, and for desuperheating and condensing the low temperature mixed refrigerant cycle high level compressor.

Figure 10C:
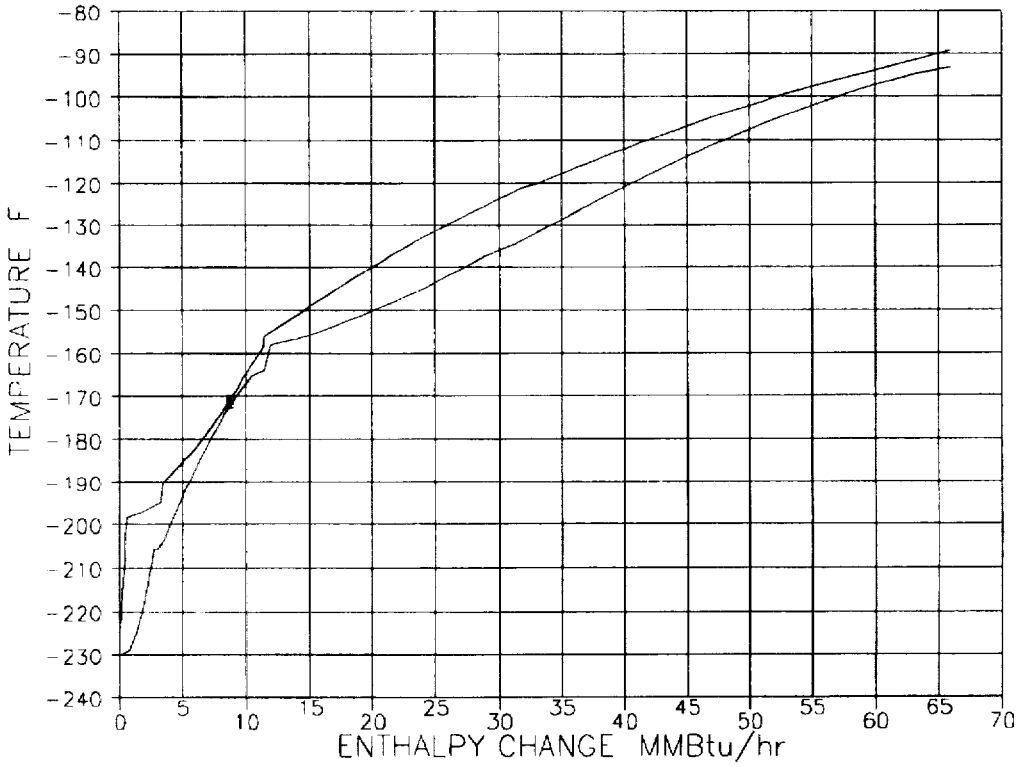
FIG. 10C shows the process and high temperature mixed refrigeration cycle composite heating and cooling curves.

FIG. 10C shows the process and high temperature mixed refrigeration cycle composite heating and cooling curves. The pinch is shown a little tight because of a failure in a simulation algorithm to properly calculate the effect of pressure drop in two phase heaters, but it can be seen that a close approach is maintained throughout the entire temperature range. As discussed above, the acetylene reactor and thermomechanically integrated C2 splitter heat exchange systems are not included in FIG. 10C because they are independently balanced.

Example 5—Capital Cost Reduction with Thermal Linking of Ethylene Recovery Fractionation Columns and Application of the Mixed Refrigerant Loops of the Present Invention Thereto The present invention will now be discussed with reference to FIGS. 11, 11A 12 and 13, in addition to reference to other previously discussed Figures. FIG. 11 shows a prior art arrangement of pressure-shells of fractionation columns for thermal linking where the overhead vapor, stream 11-2, of a first column is a side feed to a second column and a sidedraw refluxing liquid, stream 11-5, of the second column is refluxing liquid for the top stage of the first column. Internal streams of the second column are total reflux stream 11-4, remaining reflux stream 11-6, total vapor stream 11-1 and stripping section vapor 11-3. Vapor streams 11-2 and 11-3 combine to form stream 11-1.

Figure 11A:
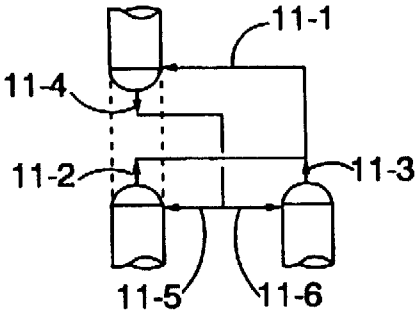
FIG. 11A shows a pressure shell support configuration of the present invention, whereby the process shown in FIG. 11 is substantially identical to that shown in FIG. 11A, although the rectification section of the second column of FIG. 11 is adapted with a separate pressure shell to be supported in a common column construction above the rectification section of the first column of FIG. 11.
Figure 11:
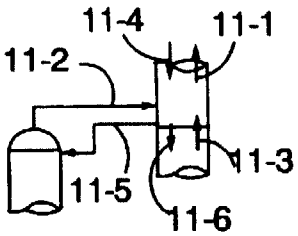
FIG. 11 shows a prior art arrangement of pressure shells of fractionation columns for thermal linking where the overhead vapor of a first column is a side feed to a second column and a sidedraw refluxing liquid of the second column is refluxing liquid for the top stage of the first column.

FIG. 11A shows a pressure shell support configuration of the present invention, whereby the process shown in FIG. 11 is substantially identical to that shown in FIG. 11A, although the rectification section of the second column of FIG. 11 is adapted with a separate pressure shell to be supported in a common column construction above the rectification section of the first column of FIG. 11. The stream numbers of FIG. 11A are the same as those of FIG. 11 and the flow rates, composition and conditions of those streams are intended to be the same for both Figures. It has been found that thermal linking, especially in conjunction with component distribution of the process shown in FIG. 9, creates an opportunity to advantageously combine rectification sections with relatively similar column diameters in a common column construction, while separating to another common column construction the stripping sections of those columns. The broken lines of FIG. 11A indicate a common support shell for two rectification sections, whereby the rectification section of the second column of FIG. 11 is located immediately above the rectification section of the first column of FIG. 11 to reduce thermal linking transfer conduits and piping.

Figure 12:
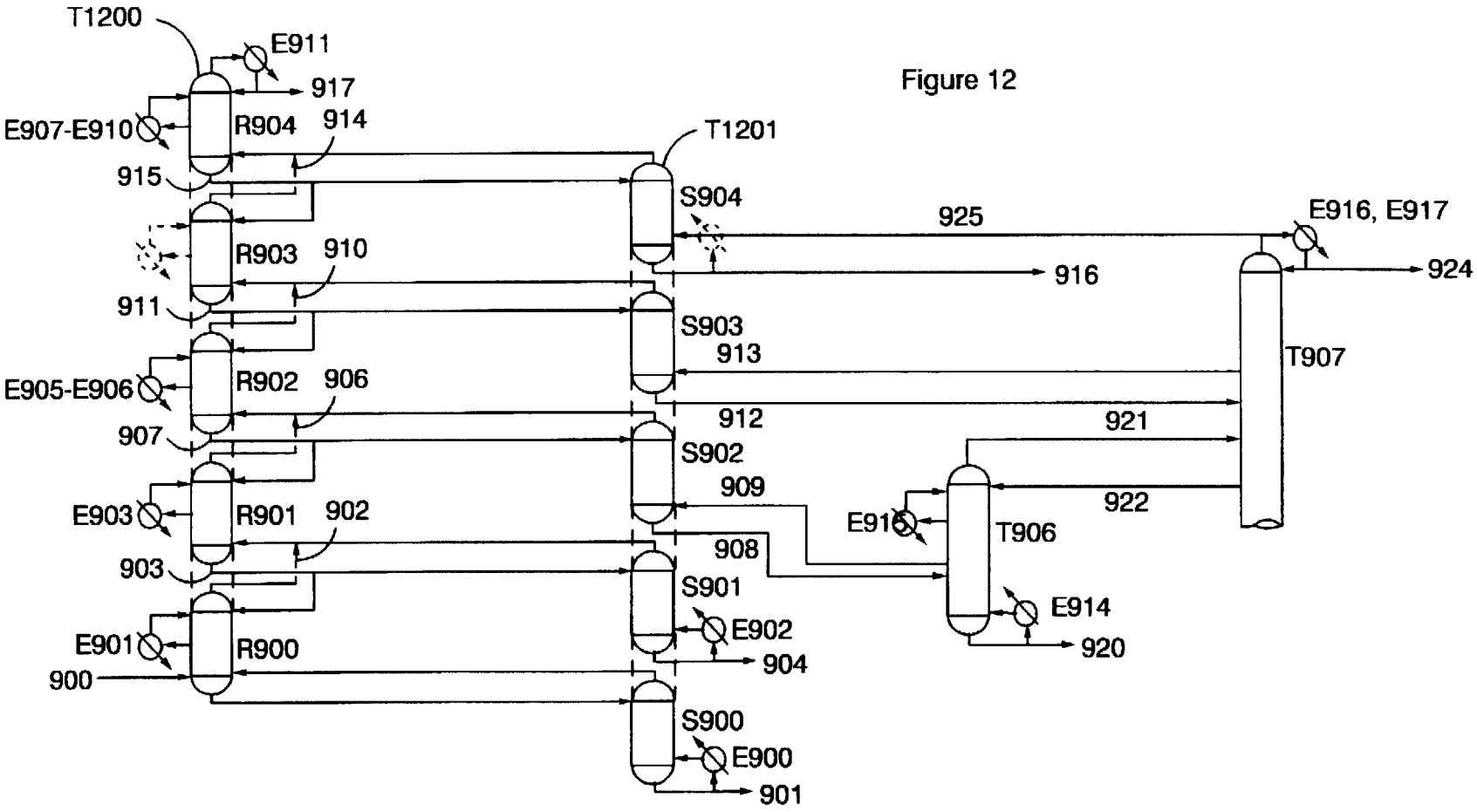
FIG. 12 is the process of the present invention as shown in FIG. 9, although as described for FIG. 11A, the rectification sections of five columns are structurally supported in a single column construction. In addition, the stripping sections of those same columns are also structurally supported in another single column construction.

The full application of the concept of FIG. 11A to the process described above for FIG. 9 is shown in FIG. 12. The rectification and stripping sections of column T900 are sections R900 and S900 respectively and so on for columns T901, T902, T903 and T904. The rectification sections of five columns are structurally supported in a single column construction, column T1200. The stripping sections of five columns are also structurally supported in a single column construction, column T1201. It is preferable that all the stripping and rectification sections are separately constructed in a common support shell, although of course any two or more or such rectification or stripping sections are within the objects of this embodiment of the present invention. The most important factors in deciding on the diameter of a column are the ranges of the vapor and liquid flow rates of the process compared to an economic optimum to reduce or eliminate changes in pressure shell diameter in final construction. Combination of most of the rectification sections of the process shown in FIG. 9 and duplicated in relevant part in FIG. 12 reduces the total number of columns constructed for the process and thus capital cost is also reduced. The stream and item numbers shown in FIG. 9 and duplicated in FIG. 12 are intended to indicate that the process streams and processes are substantially identical for the processes of both Figures.

Figure 13:
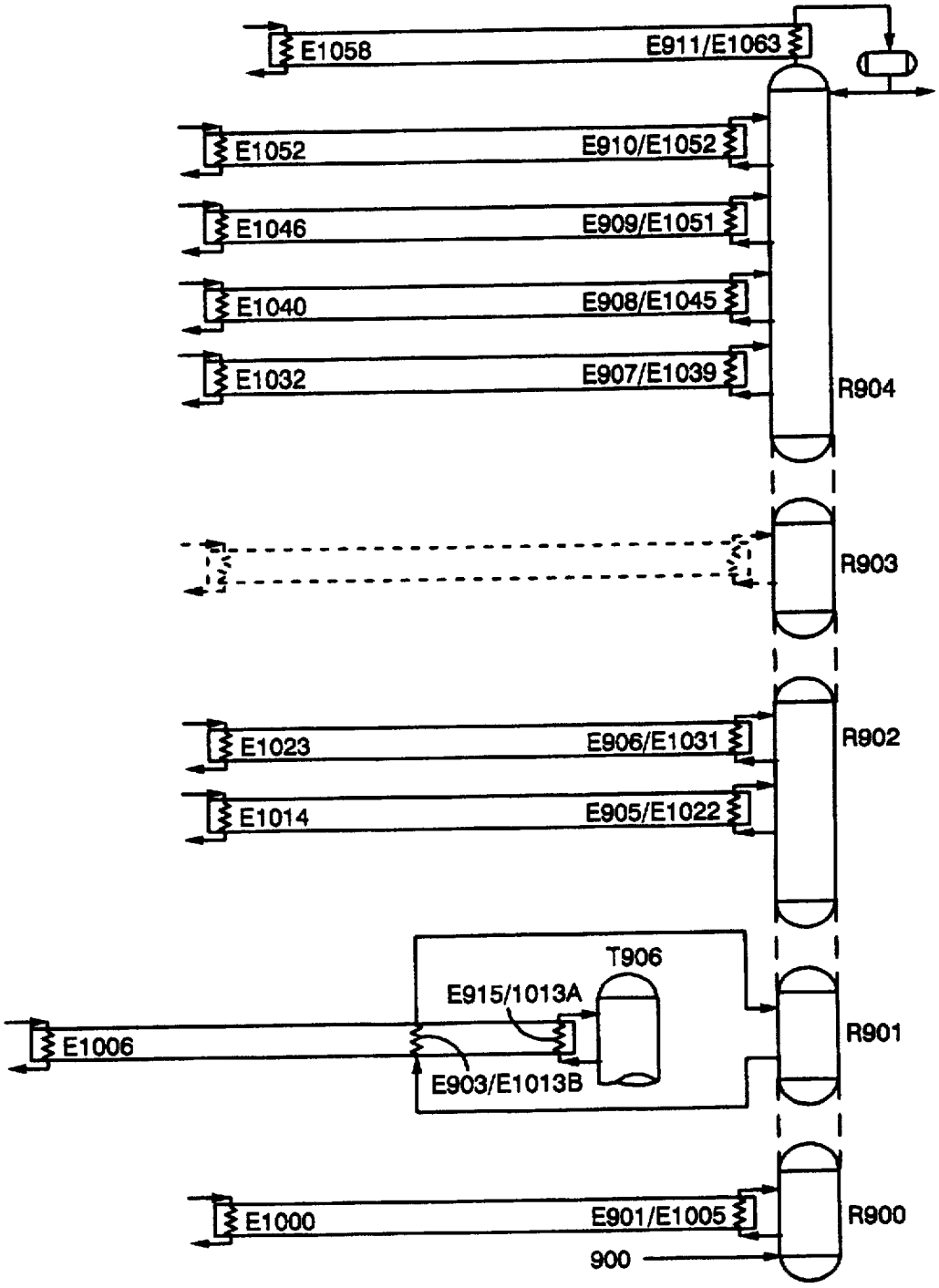
FIG. 13 shows the rectification sections of the process and stacked construction of FIG. 12 with condensing duty relationship to the cooling mixed refrigerant streams of the present invention, illustrating the locations in the ethylene fractionation train rectification sections where cooling mixed refrigerant streams of the present invention are applied.

In a further advantageous application of the common construction and illustration of the location of mixed refrigerant cooling in the present invention, FIG. 13 shows in relevant part just the rectification sections of FIG. 12 which are refrigerated with the mixed refrigerant loops for the process described in FIGS. 9, 10 and 10A. Of the several heat transfer steps shown for the multi-stream heat exchange stages shown in FIGS. 10 and 10A, only the heat transfer steps of the cooling mixed refrigerants and the condensing process are shown for simplicity and for illustration that the condensing process heat transfer to vaporizing mixed refrigerant may take place independent of the other heat transfers shown in FIGS. 10 and 10A.

Rectification sections R900, R901, R902, R903 and R904 and the top, rectification section of column T906 are shown in FIG. 13 with their associated intercondensers E901, E903, E905–E910, E915 and condenser E911. It will be apparent from the vertical arrangement of decreasing temperature mixed refrigerant cooling from the bottom of FIG. 13 to the top of FIG. 13 that the location of process condensing heat transfer with mixed refrigerant cooling may advantageously be applied at nearly any separation stage in that vertical separation progression. The rectification section R903 shows associated therewith an intercondensation step in broken lines, indicating that such an intercondensing step might be applied to that rectification section. As used herein, the high level mixed refrigerant loop alone may advantageously be used for only a single condensing step on just one of the rectification sections shown in FIG. 13 or even more than all the condensing steps shown in FIG. 13, depending on desired optimization of energy and capital for a specific application of the present invention, including whether or not to use the embodiment of having common rectification and/or stripping section construction. Thus, the number and rectification stage location of the condensing or intercondensing step(s) are subject to wide variation depending on specific applications, an certain level of optimization of which is shown in FIGS. 9, 10, 10A, 12 and 13.

It will also be indicated by the present invention that variation in the components and relative composition of the mixed refrigerants of the present invention may advantageously and with relative ease be varied to approximate the major components and their relative compositions in the condensing process streams in the rectification sections of the fractionation trains appropriate for ethylene fractionation. Because originating feeds for pyrolysis or cracked gas result in widely varying relative molar compositions for the cracked gas, the present invention is made highly adaptable with respect to varying mixed refrigerant components and compositions.

In a further embodiment of the apparatus configuration of FIG. 11A, it will be an additional advantage to remove the heads of the pressure shells from which streams 114 and 11-2 are shown being removed. The broken line of FIG. 11A will then become the pressure shell for the column, wherein a "chimney" or "holdup" tray with significant liquid retention depth is placed in vertical cross-section of the column, from which are drawn streams 11-5 and 11-6. Cost reduction is achieved with replacement of this type of tray for the two pressure shell heads just described.

It is known in the prior art, such as in U.S. Pat. No. 4,230,533 (which patent is incorporated herein), that vertical column partitions may advantageously be used for incomplete separation of an A-B-C component mixture. It has been shown in the above discussion related to the process shown in FIGS. 9 and 12 that component distribution at columns in the fractionation sequence of ethylene are of particular thermodynamic benefit for practice of the mixed refrigerant process of the present invention. The relatively broader component composition in the process streams at mixed refrigerant rectification condensation steps improves the thermodynamic efficiency of the process and reduces approach temperatures with continuity not found in the prior art for this process. Vertical partitions may thus be used in mechanical embodiments of the process of the present invention to combine whole columns or sections of columns, thereby reducing capital cost. For example, in FIG. 9, the stripping section of column T904 and the upper rectification section of column T907 could be physically located in column T903 on the other side of a vertical partition preventing exchange of streams through the partition. In the combined column, an intercondenser would be required at the top stage of the removed upper rectification section of column T907 to provide the same refluxing duty provided by the condenser heat transfer stages for that column shown in FIG. 9. There are thus several other locations in the process of the present invention that such column combinations may be made with vertical column partitions, which choices may be optimized with due consideration for similar process temperatures and pressures with relation to total installed costs for the fractionation train.

The above design options will sometimes present the designer with considerable and wide ranges from which to choose appropriate process modifications and objects of the present invention for the above examples. However, the objects of the present invention will still be obtained by the skilled person applying such design options in an appropriate manner.

TABLE 1

| Stream | 100 | 101/A | 102 | 103/A | 104 | 105/A | 106 | 107/A | 108 | 109 |
|---|---|---|---|---|---|---|---|---|---|---|
| Vap. frac. | 1.0000 | 1.0000 | 0.0000 | 1.0000 | 0.0000 | 1.0000 | 0.0000 | 1.0000 | 0.0000 | 0.7761 |
| Deg. F. | 100.0 | 64.9 | 64.9 | 29.8 | 29.8 | −8.1 | −8.1 | −49.3 | −49.3 | −91.0 |
| Psia | 539.0 | 537.0 | 537.0 | 535.0 | 535.0 | 533.0 | 533.0 | 531.0 | 531.0 | 529.0 |
| Lbmole/hr | 15,599 | 15,298 | 300 | 14,188 | 1,110 | 12,154 | 2,035 | 9,638 | 2,516 | 9,638 |
| Mlb/hr | 343.00 | 328.85 | 14.15 | 285.54 | 43.30 | 218.01 | 67.54 | 145.34 | 72.66 | 145.34 |
| Barrel/day | 65,065 | 63,319 | 1,746 | 57,203 | 6,116 | 46,569 | 10,634 | 34,005 | 12,564 | 34,005 |
| Mole Fraction | | | | | | | | | | |
| Hydrogen | 0.2132 | 0.2173 | 0.0076 | 0.2335 | 0.0101 | 0.2704 | 0.0127 | 0.3369 | 0.0155 | 0.3369 |
| Methane | 0.2743 | 0.2786 | 0.0542 | 0.2946 | 0.0744 | 0.3266 | 0.1033 | 0.3718 | 0.1532 | 0.3718 |
| CO | 0.0005 | 0.0005 | 0.0000 | 0.0005 | 0.0000 | 0.0006 | 0.0001 | 0.0007 | 0.0001 | 0.0007 |
| Acetylene | 0.0044 | 0.0045 | 0.0037 | 0.0044 | 0.0049 | 0.0041 | 0.0064 | 0.0031 | 0.0080 | 0.0031 |
| Ethylene | 0.2937 | 0.2956 | 0.1965 | 0.2974 | 0.2731 | 0.2843 | 0.3753 | 0.2304 | 0.4907 | 0.2304 |
| Ethane | 0.0785 | 0.0786 | 0.0740 | 0.0767 | 0.1031 | 0.0670 | 0.1346 | 0.0447 | 0.1528 | 0.0447 |
| M-Acetyl. | 0.0010 | 0.0009 | 0.0038 | 0.0007 | 0.0041 | 0.0003 | 0.0031 | 0.0001 | 0.0013 | 0.0001 |
| Propadl. | 0.0006 | 0.0006 | 0.0021 | 0.0005 | 0.0024 | 0.0002 | 0.0019 | 0.0000 | 0.0009 | 0.0000 |
| Propene | 0.0665 | 0.0645 | 0.1653 | 0.0536 | 0.2043 | 0.0304 | 0.1923 | 0.0088 | 0.1132 | 0.0088 |
| Propane | 0.0341 | 0.0330 | 0.0935 | 0.0264 | 0.1163 | 0.0137 | 0.1028 | 0.0033 | 0.0533 | 0.0033 |
| 13-Butadl. | 0.0112 | 0.0098 | 0.0797 | 0.0053 | 0.0682 | 0.0012 | 0.0296 | 0.0001 | 0.0055 | 0.0001 |
| 1-Butene | 0.0082 | 0.0073 | 0.0551 | 0.0040 | 0.0489 | 0.0010 | 0.0222 | 0.0001 | 0.0043 | 0.0001 |
| n-Butane | 0.0005 | 0.0004 | 0.0034 | 0.0002 | 0.0028 | 0.0001 | 0.0013 | 0.0000 | 0.0003 | 0.0000 |
| 1-Pentene | 0.0090 | 0.0067 | 0.1277 | 0.0021 | 0.0859 | 0.0002 | 0.0133 | 0.0000 | 0.0010 | 0.0000 |
| 1-Hexene | 0.0007 | 0.0003 | 0.0185 | 0.0000 | 0.0042 | 0.0000 | 0.0003 | 0.0000 | 0.0000 | 0.0000 |
| Benzene | 0.0036 | 0.0014 | 0.1147 | 0.0001 | 0.0172 | 0.0000 | 0.0008 | 0.0000 | 0.0000 | 0.0000 |

| Stream | 150 | 151 | 152 | 153 | 154 | 155 | 156 | 157 | 158 | 159 |
|---|---|---|---|---|---|---|---|---|---|---|
| Vap. frac. | 0.0000 | 0.0000 | 0.0252 | 1.0000 | 0.0000 | 0.0000 | 0.0226 | 1.0000 | 0.0000 | 0.0000 |
| Deg. F. | 64.9 | 64.9 | 59.9 | 90.0 | 29.8 | 29.8 | 24.8 | 59.9 | −8.1 | −8.1 |
| Psia | 522.6 | 522.6 | 340.9 | 338.9 | 520.6. | 520.6 | 221.5 | 219.5 | 518.6 | 518.6 |
| Lbmole/hr | 18,190 | 6,053 | 6,053 | 6,053 | 12,136 | 4,052 | 4,052 | 4,052 | 8,085 | 3,464 |
| Mlb/hr | 647.15 | 215.37 | 215.37 | 215.37 | 431.78 | 144.15 | 144.15 | 144.15 | 287.64 | 123.24 |
| Barrel/day | 104,232 | 34,688 | 34,688 | 34,688 | 69,544 | 23,217 | 23,217 | 23,217 | 46,327 | 19,849 |
| Mole Fraction | | | | | | | | | | |
| Ethylene | 0.14 | 0.14 | 0.14 | 0.14 | 0.14 | 0.14 | 0.14 | 0.14 | 0.14 | 0.14 |
| Ethane | 0.44 | 0.44 | 0.44 | 0.44 | 0.44 | 0.44 | 0.44 | 0.44 | 0.44 | 0.44 |
| Propene | 0.05 | 0.05 | 0.05 | 0.05 | 0.05 | 0.05 | 0.05 | 0.05 | 0.05 | 0.05 |
| Propane | 0.37 | 0.37 | 0.37 | 0.37 | 0.37 | 0.37 | 0.37 | 0.37 | 0.37 | 0.37 |

| Stream | 160 | 161 | 162 | 163 | 164 | 165 | 166/7 | 168 | 169 | 170 |
|---|---|---|---|---|---|---|---|---|---|---|
| Vap. frac. | 0.0232 | 1.0000 | 0.0000 | 0.0000 | 0.0237 | 1.0000 | 0.0000 | 0.0238 | 1.0000 | 1.0000 |
| Deg. F. | −13.1 | 25.7 | −49.3 | −49.3 | −54.3 | −13.1 | −91.0 | −96.0 | −54.3 | 31.8 |
| Psia | 126.7 | 126.7 | 516.6 | 516.6 | 63.5 | 61.5 | 514.6 | 26.3 | 24.3 | 61.5 |
| Lbmole/hr | 3,464 | 3,464 | 4,621 | 2,788 | 2,788 | 2,788 | 1,833 | 1,833 | 1,833 | 1,833 |
| Mlb/hr | 123.24 | 123.24 | 164.40 | 99.20 | 99.20 | 99.20 | 65.20 | 65.20 | 65.20 | 65.20 |

TABLE 1-continued

| | | | | | | | | | | |
|---|---|---|---|---|---|---|---|---|---|---|
| Barrel/day | 19,849 | 19,849 | 26,478 | 15,977 | 15,977 | 15,977 | 10,501 | 10,501 | 10,501 | 10,501 |
| Mole Fraction | | | | | | | | | | |
| Ethylene | 0.14 | 0.14 | 0.14 | 0.14 | 0.14 | 0.14 | 0.14 | 0.14 | 0.14 | 0.14 |
| Ethane | 0.44 | 0.44 | 0.44 | 0.44 | 0.44 | 0.44 | 0.44 | 0.44 | 0.44 | 0.44 |
| Propene | 0.05 | 0.05 | 0.05 | 0.05 | 0.05 | 0.05 | 0.05 | 0.05 | 0.05 | 0.05 |
| Propane | 0.37 | 0.37 | 0.37 | 0.37 | 0.37 | 0.37 | 0.37 | 0.37 | 0.37 | 0.37 |
| Stream | 172 | 173 | 174 | 175 | 176 | | | | | |
| Vap. frac. | 1.0000 | 1.0000 | 1.0000 | 1.0000 | 0.0000 | | | | | |
| Deg. F. | 113.3 | 145.6 | 100.0 | 151.2 | 100.0 | | | | | |
| Psia | 219.5 | 341.9 | 338.9 | 527.6 | 524.6 | | | | | |
| Lbmole/hr | 8,085 | 12,136 | 12,136 | 18,190 | 18,190 | | | | | |
| Mlb/hr | 287.64 | 431.78 | 431.78 | 647.15 | 647.15 | | | | | |
| Barrel/day | 46,327 | 69,544 | 69,544 | 104,232 | 104,232 | | | | | |
| Mole Fraction | | | | | | | | | | |
| Ethylene | 0.14 | 0.14 | 0.14 | 0.14 | 0.14 | | | | | |
| Ethane | 0.44 | 0.44 | 0.44 | 0.44 | 0.44 | | | | | |
| Propene | 0.05 | 0.05 | 0.05 | 0.05 | 0.05 | | | | | |
| Propane | 0.37 | 0.37 | 0.37 | 0.37 | 0.37 | | | | | |
| Exch. No. | C100 | C101 | C102 | C103 | C104 | E100 | E101 | | | |
| MMBtu/hr | 50.5 | 34.2 | 29 | 23.1 | 14.8 | 78.3 | 10.3 | | | |

TABLE 2

| Stream | 200 | 201/A | 202 | 203/A | 204 | 205/A | 206 | 207/A | 208 | 209/A |
|---|---|---|---|---|---|---|---|---|---|---|
| Vap. frac | 1.0000 | 1.0000 | 0.0000 | 1.0000 | 0.0000 | 1.0000 | 0.0000 | 1.0000 | 0.0000 | 1.0000 |
| Deg. F. | 100.0 | 64.9 | 64.9 | 29.8 | 29.8 | −8.1 | −8.1 | −49.3 | −49.3 | −91.0 |
| Psia | 539.0 | 537.0 | 537.0 | 535.0 | 535.0 | 533.0 | 533.0 | 531.0 | 531.0 | 529.0 |
| Lbmole/hr | 15,599 | 15,298 | 300 | 14,188 | 1,110 | 12,154 | 2,035 | 9,638 | 2,516 | 7,460 |
| Mlb/hr | 343.00 | 328.85 | 14.15 | 285.54 | 43.30 | 218.01 | 67.54 | 145.34 | 72.66 | 89.85 |
| Barrel/day | 65,065 | 63,319 | 1,746 | 57,203 | 6,116 | 46,569 | 10,634 | 34,005 | 12,564 | 23,720 |
| Mole Fraction | | | | | | | | | | |
| Hydrogen | 0.2132 | 0.2173 | 0.0076 | 0.2335 | 0.0101 | 0.2704 | 0.0127 | 0.3369 | 0.0155 | 0.4289 |
| Methane | 0.2743 | 0.2786 | 0.0542 | 0.2946 | 0.0744 | 0.3266 | 0.1033 | 0.3718 | 0.1532 | 0.4104 |
| CO | 0.0005 | 0.0005 | 0.0000 | 0.0005 | 0.0000 | 0.0006 | 0.0001 | 0.0007 | 0.0001 | 0.0008 |
| Acetylene | 0.0044 | 0.0045 | 0.0037 | 0.0044 | 0.0049 | 0.0041 | 0.0064 | 0.0031 | 0.0080 | 0.0016 |
| Ethylene | 0.2937 | 0.2956 | 0.1965 | 0.2974 | 0.2731 | 0.2843 | 0.3753 | 0.2304 | 0.4907 | 0.1378 |
| Ethane | 0.0785 | 0.0786 | 0.0740 | 0.0767 | 0.1031 | 0.0670 | 0.1346 | 0.0447 | 0.1528 | 0.0191 |
| M-Acetyl. | 0.0010 | 0.0009 | 0.0038 | 0.0007 | 0.0041 | 0.0003 | 0.0031 | 0.0001 | 0.0013 | 0.0000 |
| Propadl. | 0.0006 | 0.0006 | 0.0021 | 0.0005 | 0.0024 | 0.0002 | 0.0019 | 0.0000 | 0.0009 | 0.0000 |
| Propane | 0.0341 | 0.0330 | 0.0935 | 0.0264 | 0.1163 | 0.0137 | 0.1028 | 0.0033 | 0.0533 | 0.0003 |
| 13-Butadl. | 0.0112 | 0.0098 | 0.0797 | 0.0053 | 0.0682 | 0.0012 | 0.0296 | 0.0001 | 0.0055 | 0.0000 |
| 1-Butene | 0.0082 | 0.0073 | 0.0551 | 0.0040 | 0.0469 | 0.0010 | 0.0222 | 0.0001 | 0.0043 | 0.0000 |
| n-Butane | 0.0005 | 0.0004 | 0.0034 | 0.0002 | 0.0028 | 0.0001 | 0.0013 | 0.0000 | 0.0003 | 0.0000 |
| 1-Pentene | 0.0090 | 0.0067 | 0.1277 | 0.0021 | 0.0659 | 0.0002 | 0.0133 | 0.0000 | 0.0010 | 0.0000 |
| 1-Hexene | 0.0007 | 0.0063 | 0.0185 | 0.0000 | 0.0042 | 0.0000 | 0.0003 | 0.0000 | 0.0000 | 0.0000 |
| Benzene | 0.0036 | 0.0014 | 0.1147 | 0.0001 | 0.0172 | 0.0000 | 0.0008 | 0.0000 | 0.0000 | 0.0000 |

| Stream | 210 | 211A | 212 | 213 |
|---|---|---|---|---|
| Vap. frac | 0.0000 | 1.0000 | 0.0000 | 0.8658 |
| Deg. F. | −91.0 | −121.0 | −121.0 | −156.0 |
| Psia | 529.0 | 527.0 | 527.0 | 525.0 |
| Lbmole/h | 2,158 | 6,459 | 1,022 | 6,459 |
| Mlb/hr | 55.50 | 65.51 | 24.34 | 65.51 |
| Barrel/day | 10,286 | 19,045 | 4,674 | 19,045 |
| Mole Fraction | | | | |
| Hydrogen | 0.0180 | 0.4937 | 0.0193 | 0.4937 |
| Methane | 0.2381 | 0.4220 | 0.3369 | 0.4220 |
| CO | 0.0001 | 0.0010 | 0.0002 | 0.0010 |
| Acetylene | 0.0083 | 0.0007 | 0.0071 | 0.0007 |
| Ethylene | 0.5517 | 0.0754 | 0.5322 | 0.0754 |
| Ethane | 0.1333 | 0.0071 | 0.0949 | 0.0071 |
| M-Acetyl. | 0.0002 | 0.0000 | 0.0000 | 0.0000 |
| Propadl. | 0.0002 | 0.0000 | 0.0000 | 0.0000 |
| Propene | 0.0355 | 0.0001 | 0.0072 | 0.0001 |
| Propane | 0.0137 | 0.0000 | 0.0021 | 0.0000 |
| 13-Butadl. | 0.0004 | 0.0000 | 0.0000 | 0.0000 |
| 1-Butene | 0.0003 | 0.0000 | 0.0000 | 0.0000 |

TABLE 2-continued

| Stream | 250 | 251 | 252 | 253 | 254 | 255 | 256 | 257 | 258 | 259 |
|---|---|---|---|---|---|---|---|---|---|---|
| Vap. frac | 0.0000 | 0.0000 | 0.0252 | 1.0000 | 0.0000 | 0.0000 | 0.0226 | 1.0000 | 0.0000 | 0.0000 |
| Deg. F. | 64.9 | 64.9 | 59.9 | 90.0 | 29.8 | 29.8 | 24.8 | 59.9 | −8.1 | −8.1 |
| Psia | 522.6 | 522.6 | 340.9 | 338.9 | 520.6 | 520.6 | 221.5 | 219.5 | 518.6 | 518.6 |
| Lbmole/hr | 22,492 | 7,076 | 7076 | 7,076 | 15,415 | 4,738 | 4,738 | 4,738 | 10,677 | 4,050 |
| Mlb/hr | 800.21 | 251.77 | 251.77 | 251.77 | 548.44 | 168.56 | 168.56 | 168.56 | 379.88 | 144.10 |
| Barrel/day | 128,883 | 40,550 | 40550 | 40,550 | 88,333 | 27,149 | 27,149 | 27,149 | 61,184 | 23,209 |
| Mole Fraction | | | | | | | | | | |
| Ethylene | 0.14 | 0.14 | 0.14 | 0.14 | 0.14 | 0.14 | 0.14 | 0.14 | 0.14 | 0.14 |
| Ethane | 0.44 | 0.44 | 0.44 | 0.44 | 0.44 | 0.44 | 0.44 | 0.44 | 0.44 | 0.44 |
| Propene | 0.05 | 0.05 | 0.05 | 0.05 | 0.05 | 0.05 | 0.05 | 0.05 | 0.05 | 0.05 |
| Propane | 0.37 | 0.37 | 037 | 0.37 | 0.37 | 0.37 | 0.37 | 0.37 | 0.37 | 0.37 |

| Stream | 260 | 261 | 262 | 263 | 264 | 265 | 266/7 | 268 | 269 | 270 |
|---|---|---|---|---|---|---|---|---|---|---|
| Vap. frac | 0.0232 | 1.0000 | 0.0000 | 0.0000 | 0.0237 | 1.0000 | 0.0000 | 0.0238 | 1.0000 | 1.0000 |
| Deg. F. | −13.1 | 25.7 | −49.3 | −49.3 | −54.3 | −13.1 | −91.0 | −96.0 | −54.3 | 31.8 |
| Psia | 128.7 | 126.7 | 516.6 | 516.6 | 63.5 | 61.5 | 514.6 | 26.3 | 24.3 | 61.5 |
| Lbmole/hr | 4,050 | 4,050 | 6,627 | 3,535 | 3,535 | 3,535 | 3,092 | 3,092 | 3,092 | 3,092 |
| Mlb/hr | 144.10 | 144.10 | 235.78 | 125.76 | 125.76 | 125.76 | 110.02 | 110.02 | 110.02 | 110.02 |
| Barrel/day | 23,209 | 23,209 | 37,975 | 20,256 | 20,256 | 20,256 | 17,720 | 17,720 | 17,720 | 17,720 |
| Mole Fraction | | | | | | | | | | |
| Ethylene | 0.14 | 0.14 | 0.14 | 0.14 | 0.14 | 0.14 | 0.14 | 0.14 | 0.14 | 0.14 |
| Ethane | 0.44 | 0.44 | 0.44 | 0.44 | 0.44 | 0.44 | 0.44 | 0.44 | 0.44 | 0.44 |
| Propene | 0.05 | 0.05 | 005 | 0.05 | 0.05 | 0.05 | 0.05 | 0.05 | 0.05 | 0.05 |
| Propane | 0.37 | 0.37 | 0.37 | 0.37 | 0.37 | 0.37 | 0.37 | 0.37 | 0.37 | 0.37 |

| Stream | 271 | 272 | 273 | 274 | 275 | 276 |
|---|---|---|---|---|---|---|
| Vap. frac | 1.0000 | 1.0000 | 1.0000 | 1.0000 | 1.0000 | 0.0000 |
| Deg. F. | 80.0 | 117.9 | 150.2 | 100.0 | 151.4 | 100.0 |
| Psia | 126.7 | 219.5 | 341.9 | 338.9 | 527.6 | 524.6 |
| Lbmole/hr | 6,627 | 10,677 | 15,415 | 15,415 | 22,492 | 22,492 |
| Mlb/hr | 235.78 | 379.88 | 548.44 | 548.44 | 800.21 | 800.21 |
| Barrel/day | 37,975 | 61,184 | 88,333 | 88,333 | 128,883 | 128,883 |
| Mole Fraction | | | | | | |
| Ethylene | 0.14 | 0.14 | 0.14 | 0.14 | 0.14 | 0.14 |
| Ethane | 0.44 | 0.44 | 0.44 | 0.44 | 0.44 | 0.44 |
| Propene | 0.05 | 0.05 | 0.05 | 0.05 | 0.05 | 0.05 |
| Propane | 0.37 | 0.37 | 0.37 | 0.37 | 0.37 | 0.37 |

| Stream | 277 | 278 | 279 | 280 | 281 | 282 | 283 | 284 | 285 | 286 |
|---|---|---|---|---|---|---|---|---|---|---|
| Vap. frac | 1.0000 | 1.0000 | 0.8194 | 0.0000 | 0.0000 | 0.0000 | 0.0315 | 0.5433 | 1.0000 | 1.0000 |
| Deg. F. | 29.8 | −8.1 | −49.3 | −91.0 | −121.0 | −156.0 | −161.0 | −127.0 | −96.0 | 54.0 |

TABLE 2-continued

| | | | | | | | | | | |
|---|---|---|---|---|---|---|---|---|---|---|
| Psia | 509.3. | 507.3 | 505.3 | 503.3 | 501.3 | 499.3 | 165.3 | 163.3 | 161.3 | 511.3 |
| Lbmole/hr | 3,210 | 3,210 | 3210 | 3,210 | 3,210 | 3,210 | 3,210 | 3,210 | 3,210 | 3,210 |
| Mlb/hr | 68.86 | 68.86 | 68.86 | 68.86 | 68.86 | 68.86 | 68.86 | 68.86 | 68.86 | 68.86 |
| Barrel/day | 13,720 | 13,720 | 13,720 | 13,720 | 13,720 | 13,720 | 13,720 | 13,720 | 13,720 | 13,720 |
| Mole Fraction | | | | | | | | | | |
| Methane | 0.55 | 0.55 | 0.55 | 0.55 | 0.55 | 0.55 | 0.55 | 0.55 | 0.55 | 0.55 |
| Ethylene | 0.45 | 0.45 | 0.45 | 0.45 | 0.45 | 0.45 | 0.45 | 0.45 | 0.45 | 0.45 |
| Exch. No. | C200 | C201 | C202 | C203 | C204 | C205 | C206 | E200 | E201 | |
| MMBtu/hr | 60.4 | 41.1 | 35.0 | 30.0 | 25.0 | 9.3 | 8.4 | 96.9 | 14.4 | |

TABLE 3

| | | Cascade E/P | Cascade MLMR | Ratio |
|---|---|---|---|---|
| Compressor Power | HP | 16,990 | 14,409 | 85% |
| Compressor Suction | ACFM | 76,614 | 35,836 | 47% |
| Heat Exchange | MMBtu/Hr | 220 | 240 | 109% |
| Cooling Water | Mlb/Hr | 11,130 | 3,492 | 31% |
| Pump Power | HP | 867 | 275 | 32% |

TABLE 4

| Stream | 900 | 901 | 902 | 903 | 904 | 905 | 906 | 907 |
|---|---|---|---|---|---|---|---|---|
| Vap. frac. | 0.9809 | 0.0000 | 1.0000 | 0.0000 | 0.0000 | 1.0000 | 1.0000 | 0.0000 |
| Deg. F. | 100.0 | 187.6 | 55.3 | 55.0 | 182.1 | 100.0 | 21.4 | 11.8 |
| Psia | 268.4 | 71.1 | 259.0 | 264.0 | 261.4 | 242.9 | 239.9 | 254.9 |
| Lbmole/hr | 26,602 | 1,031 | 27,963 | 2,579 | 1,383 | 29,297 | 29,297 | 5,685 |
| Mlb/hr | 655.28 | 72.71 | 698.41 | 119.13 | 71.53 | 721.81 | 721.81 | 214.07 |
| Barrel/day | 114,148 | 6,566 | 122,171 | 14,815 | 8,285 | 129,113 | 129,113 | 30,461 |
| Mole Fraction | | | | | | | | |
| Hydrogen | 0.1735 | 0.0000 | 0.1653 | 0.0027 | 0.0000 | 0.1448 | 0.1448 | 0.0030 |
| CO | 0.0003 | 0.0000 | 0.0003 | 0.0000 | 0.0000 | 0.0003 | 0.0003 | 0.0000 |
| CO2 | 0.0000 | 0.0000 | 0.0000 | 0.0000 | 0.0000 | 0.0000 | 0.0000 | 0.0000 |
| H2S | 0.0000 | 0.0000 | 0.0000 | 0.0000 | 0.0000 | 0.0000 | 0.0000 | 0.0000 |
| Methane | 0.2507 | 0.0000 | 0.2409 | 0.0264 | 0.0000 | 0.2334 | 0.2334 | 0.0296 |
| Acetylene | 0.0098 | 0.0000 | 0.0098 | 0.0052 | 0.0000 | 0.0000 | 0.0000 | 0.0000 |
| Ethylene | 0.3350 | 0.0000 | 0.3314 | 0.1385 | 0.0000 | 0.3543 | 0.3543 | 0.2127 |
| Ethane | 0.0448 | 0.0000 | 0.0450 | 0.0287 | 0.0001 | 0.0496 | 0.0496 | 0.0470 |
| M-Acetylene | 0.0043 | 0.0009 | 0.0057 | 0.0176 | 0.0210 | 0.0021 | 0.0021 | 0.0069 |
| Propadiene | 0.0043 | 0.0001 | 0.0054 | 0.0143 | 0.0167 | 0.0023 | 0.0023 | 0.0074 |
| Propene | 0.0902 | 0.0000 | 0.1038 | 0.1957 | 0.2084 | 0.2071 | 0.2071 | 0.6734 |
| Propane | 0.0029 | 0.0000 | 0.0035 | 0.0075 | 0.0083 | 0.0061 | 0.0061 | 0.0199 |
| 13-Butadiene | 0.0272 | 0.1269 | 0.0512 | 0.3244 | 0.4299 | 0.0000 | 0.0000 | 0.0000 |
| 1-Butene | 0.0175 | 0.0721 | 0.0338 | 0.2148 | 0.2834 | 0.0000 | 0.0000 | 0.0001 |
| n-Butane | 0.0018 | 0.0090 | 0.0034 | 0.0214 | 0.0284 | 0.0000 | 0.0000 | 0.0000 |
| 13-CC5=== | 0.0058 | 0.1489 | 0.0000 | 0.0000 | 0.0001 | 0.0000 | 0.0000 | 0.0000 |
| 2M-13-C4=== | 0.0057 | 0.1462 | 0.0001 | 0.0004 | 0.0006 | 0.0000 | 0.0000 | 0.0000 |
| 1-Pentene | 0.0018 | 0.0417 | 0.0004 | 0.0022 | 0.0031 | 0.0000 | 0.0000 | 0.0000 |
| n-Pentane | 0.0015 | 0.0375 | 0.0000 | 0.0000 | 0.0000 | 0.0000 | 0.0000 | 0.0000 |
| Benzene | 0.0128 | 0.3306 | 0.0000 | 0.0000 | 0.0000 | 0.0000 | 0.0000 | 0.0000 |
| Toluene | 0.0024 | 0.0610 | 0.0000 | 0.0000 | 0.0000 | 0.0000 | 0.0000 | 0.0000 |
| Styrene | 0.0000 | 0.0003 | 0.0000 | 0.0000 | 0.0000 | 0.0000 | 0.0000 | 0.0000 |
| m-Xylene | 0.0000 | 0.0007 | 0.0000 | 0.0000 | 0.0000 | 0.0000 | 0.0000 | 0.0000 |
| Cyclohexane | 0.0008 | 0.0214 | 0.0000 | 0.0000 | 0.0000 | 0.0000 | 0.0000 | 0.0000 |
| Mcyclohexane | 0.0001 | 0.0024 | 0.0000 | 0.0000 | 0.0000 | 0.0000 | 0.0000 | 0.0000 |
| Ecyclohexane | 0.0000 | 0.0002 | 0.0000 | 0.0000 | 0.0000 | 0.0000 | 0.0000 | 0.0000 |
| 14-EBenzene | 0.0000 | 0.0000 | 0.0000 | 0.0000 | 0.0000 | 0.0000 | 0.0000 | 0.0000 |
| H2O | 0.0070 | 0.0000 | 0.0000 | 0.0000 | 0.0000 | 0.0000 | 0.0000 | 0.0000 |

| Stream | 908 | 909 | 910 | 911 | 912 | 913 | 914 | 915 |
|---|---|---|---|---|---|---|---|---|
| Vap. frac. | 0.0000 | 1.0000 | 1.0000 | 0.0000 | 0.0000 | 1.0000 | 1.0000 | 0.0000 |
| Deg. F. | 45.7 | 50.6 | −65.0 | −64.9 | −28.2 | −27.4 | −70.4 | −70.4 |
| Psia | 241.9 | 241.9 | 233.0 | 233.0 | 235.0 | 237.5 | 228.1 | 228.1 |
| Lbmole/hr | 3,889 | 794 | 25,533 | 5,015 | 6,992 | 1,962 | 27,117 | 11,630 |
| Mlb/hr | 147.03 | 26.92 | 525.87 | 138.22 | 198.85 | 55.58 | 560.36 | 315.97 |
| Barrel/day | 21,035 | 4,223 | 107,203 | 25,359 | 36,065 | 10,044 | 112,965 | 57,142 |
| Mole Fraction | | | | | | | | |
| Hydrogen | 0.0000 | 0.0000 | 0.1662 | 0.0033 | 0.0000 | 0.0000 | 0.1572 | 0.0032 |
| CO | 0.0000 | 0.0000 | 0.0003 | 0.0000 | 0.0000 | 0.0000 | 0.0003 | 0.0000 |
| CO2 | 0.0000 | 0.0000 | 0.0000 | 0.0000 | 0.0000 | 0.0000 | 0.0000 | 0.0000 |
| H2S | 0.0000 | 0.0000 | 0.0000 | 0.0000 | 0.0000 | 0.0000 | 0.0000 | 0.0000 |
| Methane | 0.0001 | 0.0002 | 0.2741 | 0.0657 | 0.0004 | 0.0002 | 0.2744 | 0.0668 |
| Acetylene | 0.0000 | 0.0000 | 0.0000 | 0.0000 | 0.0000 | 0.0000 | 0.0000 | 0.0000 |
| Ethylene | 0.2504 | 0.4688 | 0.4824 | 0.7475 | 0.8115 | 0.8618 | 0.5677 | 0.9295 |
| Ethane | 0.0641 | 0.1334 | 0.0767 | 0.1827 | 0.1873 | 0.1380 | 0.0003 | 0.0005 |
| M-Acetylene | 0.0065 | 0.0027 | 0.0000 | 0.0000 | 0.0000 | 0.0000 | 0.0000 | 0.0000 |

TABLE 4-continued

| | | | | | | | | |
|---|---|---|---|---|---|---|---|---|
| Propadiene | 0.0070 | 0.0031 | 0.0000 | 0.0000 | 0.0000 | 0.0000 | 0.0000 | 0.0000 |
| Propene | 0.6527 | 0.3820 | 0.0004 | 0.0009 | 0.0008 | 0.0001 | 0.0000 | 0.0000 |
| Propane | 0.0191 | 0.0098 | 0.0000 | 0.0000 | 0.0000 | 0.0000 | 0.0000 | 0.0000 |
| 13-Butadiene | 0.0000 | 0.0000 | 0.0000 | 0.0000 | 0.0000 | 0.0000 | 0.0000 | 0.0000 |
| 1-Butene | 0.0001 | 0.0000 | 0.0000 | 0.0000 | 0.0000 | 0.0000 | 0.0000 | 0.0000 |
| n-Butane | 0.0000 | 0.0000 | 0.0000 | 0.0000 | 0.0000 | 0.0000 | 0.0000 | 0.0000 |
| 13-CC5=== | 0.0000 | 0.0000 | 0.0000 | 0.0000 | 0.0000 | 0.0000 | 0.0000 | 0.0000 |
| 2M-13-C4=== | 0.0000 | 0.0000 | 0.0000 | 0.0000 | 0.0000 | 0.0000 | 0.0000 | 0.0000 |
| 1-Pentene | 0.0000 | 0.0000 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 | 0.0000 |

| Stream | 916 | 917 | 918 | 919 | 920 | 921 | 922 | 923 |
|---|---|---|---|---|---|---|---|---|
| Vap. frac. | 0.0000 | 1.0000 | 0.0000 | 0.0000 | 0.0000 | 1.0000 | 0.0000 | 0.0000 |
| Deg. F. | −34.8 | −198.6 | 200.2 | 100.4 | 106.8 | −23.5 | −25.4 | |
| Psia | 230.1 | 212.3 | 227.2 | 220.0 | 245.8 | 238.0 | 238.0 | 105.0 |
| Lbmole/hr | 6,371 | 10,910 | 1,036 | 347 | 2,349 | 1,666 | 921 | 1,192 |
| Mlb/hr | 178.69 | 116.00 | 57.01 | 14.52 | 98.89 | 47.53 | 26.31 | 35.90 |
| Barrel/day | 31,931 | 32,880 | 6,419 | 1,866 | 12,964 | 8,644 | 4,796 | 6,891 |
| Mole Fraction | | | | | | | | |
| Hydrogen | 0.0000 | 0.3873 | 0.0000 | 0.0000 | 0.0000 | 0.0000 | 0.0000 | 0.0000 |
| CO | 0.0000 | 0.0008 | 0.0000 | 0.0000 | 0.0000 | 0.0000 | 0.0000 | 0.0000 |
| CO2 | 0.0000 | 0.0000 | 0.0000 | 0.0000 | 0.0000 | 0.0000 | 0.0000 | 0.0000 |
| H2S | 0.0000 | 0.0000 | 0.0000 | 0.0000 | 0.0000 | 0.0000 | 0.0000 | 0.0000 |
| Methane | 0.0005 | 0.6109 | 0.0000 | 0.0000 | 0.0000 | 0.0002 | 0.0000 | 0.0000 |
| Acetylene | 0.0000 | 0.0000 | 0.0000 | 0.0000 | 0.0000 | 0.0000 | 0.0000 | 0.0000 |
| Ethylene | 0.9990 | 0.0010 | 0.0000 | 0.0000 | 0.0000 | 0.7744 | 0.7481 | 0.0049 |
| Ethane | 0.0005 | 0.0000 | 0.0000 | 0.0004 | 0.0005 | 0.2243 | 0.2515 | 0.9893 |
| M-Acetylene | 0.0000 | 0.0000 | 0.0031 | 0.0744 | 0.0098 | 0.0000 | 0.0000 | 0.0000 |
| Propadiene | 0.0000 | 0.0000 | 0.0011 | 0.0632 | 0.0106 | 0.0000 | 0.0000 | 0.0000 |
| Propene | 0.0000 | 0.0000 | 0.0006 | 0.8289 | 0.9507 | 0.0011 | 0.0004 | 0.0057 |
| Propane | 0.0000 | 0.0000 | 0.0001 | 0.0329 | 9.0283 | 0.0000 | 0.0000 | 0.0000 |
| 13-Butadiene | 0.0000 | 0.0000 | 0.5738 | 0.0000 | 0.0000 | 0.0000 | 0.0000 | 0.0000 |
| 1-Butene | 0.0000 | 0.0000 | 0.3783 | 0.0001 | 0.0001 | 0.0000 | 0.0000 | 0.0000 |
| n-Butane | 0.0000 | 0.0000 | 0.0379 | 0.0000 | 0.0000 | 0.0000 | 0.0000 | 0.0000 |
| 13-CC5=== | 0.0000 | 0.0000 | 0.0001 | 0.0000 | | | | |
| 2M-13-C4=== | 0.0000 | 0.0000 | 0.0008 | 0.0000 | | | | |
| 1-Pentene | 0.0000 | 0.0000 | 0.0041 | 0.0000 | | | | |
| n-Pentane | 0.0000 | 0.0000 | 0.0001 | 0.0000 | | | | |

| Stream | 924 | 925 |
|---|---|---|
| Vap. frac. | 0.0000 | 1.0000 |
| Deg. F. | −35.5 | −35.5 |
| Psia | 227.2 | 227.2 |
| Lbmole/hr | 2,790 | 1,794 |
| Mlb/hr | 78.27 | 50.30 |
| Barrel/day | 13,987 | 8,990 |
| Mole Fraction | | |
| Hydrogen | 0.0000 | 0.0000 |
| CO | 0.0000 | 0.0000 |
| CO2 | 0.0000 | 0.0000 |
| H2S | 0.0000 | 0.0000 |
| Methane | 0.0002 | 0.0012 |
| Acetylene | 0.0000 | 0.0000 |
| Ethylene | 0.9993 | 0.9985 |
| Ethane | 0.0005 | 0.0003 |
| M-Acetylene | 0.0000 | 0.0000 |
| Propadiene | 0.0000 | 0.0000 |
| Propene | 0.0000 | 0.0000 |
| Propane | 0.0000 | 0.0000 |
| 13-Butadiene | 0.0000 | 0.0000 |
| 1-Butene | 0.0000 | 0.0000 |
| n-Butane | 0.0000 | 0.0000 |

| Stream | SE901 | 5E903 | SE905 | 5E906 | 5E907 | SE908 | SE909 | 5E910 |
|---|---|---|---|---|---|---|---|---|
| Vap. frac. | 0.9987 | 1.0000 | 1.0000 | 1.0000 | 1.0000 | 1.0000 | 1.0000 | 1.0000 |
| Deg. F. | 78.6 | 53.0 | 10.7 | −8.0 | −70.4 | −89.2 | −120.0 | −158.5 |
| Psia | 267.9 | 258.8 | 239.8 | 236.8 | 228.1 | 225.1 | 222.1 | 219.1 |
| Lbmole/hr | 16,667 | 10,417 | 16,667 | 15,500 | 21,000 | 15,000 | 11,000 | 8,000 |
| Mlb/hr | 420.16 | 261.61 | 413.89 | 359.75 | 435.45 | 267.09 | 157.35 | 95.96 |
| Barrel/day | 72,825 | 45,677 | 73,821 | 67,213 | 87,662 | 57,579 | 37,807 | 25,381 |

TABLE 4-continued

| Mole Fraction | | | | | | | | |
|---|---|---|---|---|---|---|---|---|
| Hydrogen | 0.1666 | 0.1611 | 0.1407 | 0.1521 | 0.1517 | 0.2142 | 0.2898 | 0.3369 |
| CO | 0.0003 | 0.0003 | 0.0003 | 0.0003 | 0.0003 | 0.0005 | 0.0006 | 0.0007 |
| CO2 | 0.0000 | 0.0000 | 0.0000 | 0.0000 | 0.0000 | 0.0000 | 0.0000 | 0.0000 |
| H2S | 0.0000 | 0.0000 | 0.0000 | 0.0000 | 0.0000 | 0.0000 | 0.0000 | 0.0000 |
| Methane | 0.2424 | 0.2366 | 0.2301 | 0.2485 | 0.2805 | 0.3889 | 0.5166 | 0.6067 |
| Acetylene | 0.0097 | 0.0099 | 0.0000 | 0.0000 | 0.0000 | 0.0000 | 0.0000 | 0..0000 |
| Ethylene | 0.3308 | 0.3339 | 0.3563 | 0.3967 | 0.5673 | 0.3964 | 0.1930 | 0.0557 |
| Ethane | 0.0446 | 0.0462 | 0.0518 | 0.0613 | 0.0002 | 0.0001 | 0.0000 | 0.0000 |
| M-Acetylene | 0.0052 | 0.0077 | 0.0010 | 0.0004 | 0.0000 | 0.0000 | 0.0000 | 0.0000 |
| Propadiene | 0.0050 | 0.0065 | 0.0013 | 0.0005 | 0.0000 | 0.0000 | 0.0000 | 0.0000 |
| Propene | 0.0984 | 0.1103 | 0.2135 | 0.1374 | 0.0000 | 0.0000 | 0.0000 | 0.0000 |
| Propane | 0.0033 | 0.0037 | 0.0050 | 0.0026 | 0.0000 | 0.0000 | 0.0000 | 0.0000 |
| 13-Butadiene | 0.0376 | 0.0449 | 0.0000 | 0.0000 | 0.0000 | 0.0000 | 0.0000 | 0.0000 |
| 1-Butene | 0.0236 | 0.0360 | 0.0000 | 0.0000 | 0.0000 | 0.0000 | 0.0000 | 0.0000 |
| n-Butane | 0.0026 | 0.0029 | 0.0000 | 0.0000 | 0.0000 | 0.0000 | 0.0000 | 0.0000 |
| 13-CC5=== | 0.0045 | 0.0000 | 0.0000 | 0.0000 | 0.0000 | 0.0000 | 0.0000 | 0.0000 |
| 2M-13-C4=== | 0.0115 | 0.0000 | 0.0000 | 0.0000 | 0.0000 | 0.0000 | 0.0000 | 0.0000 |
| 1-Pentene | 0.0085 | 0.0000 | 0.0000 | 0.0000 | 0.0000 | 0.0000 | 0.0000 | 0.0000 |
| n-Pentane | 0.0023 | 0.0000 | 0.0000 | 0.0000 | 0.0000 | 0.0000 | 0.0000 | 0.0000 |
| H2O | 0.0031 | 0.0000 | 0.0000 | 0.0000 | 0.0000 | 0.0000 | 0.0000 | 0.0000 |
| Exchanger | E900 | E901 | E902 | E903 | E905 | E906 | E907 | E908 |
| MMBtu/Hr | 6.91 | 6.76 | 8.67 | 9.31 | 18.16 | 30.73 | 37.88 | 26.46 |
| Exchanger | E909 | E910 | E911 | E912 | E913 | E914 | E915 | E916 |
| MMBtu/Hr | 13.72 | 7.26 | 2.65 | 12.75 | 12.88 | 15.92 | 2.16 | 23.14 |
| Exchanger | E917 | E950 | E951 | E952 | E953 | E954 | E955 | E956 |
| MMBtu/Hr | 43.23 | 0.34 | 12.63 | 11.81 | 0.49 | 1.02 | 11.86 | 10.84 |

| Stream | 300 | 301 | 302 | 303 | 304 | 305 | 306 | 307 |
|---|---|---|---|---|---|---|---|---|
| Vap. frac. | 1.0000 | 1.0000 | 1.0000 | 1.0000 | 1.0000 | 1.0000 | 1.0000 | 1.0000 |
| Deg. F. | 71.7 | 29.8 | −8.1 | −49.3 | −91.0 | −92.7 | 48.5 | 29.8 |
| Psia | 180.9 | 178.9 | 176.9 | 174.9 | 172.9 | 172.9 | 511.4 | 509.4 |
| Lbmole/hr | 1,522 | 1,522 | 1,522 | 1,522 | 1,522 | 12,642 | 12,642 | 12,642 |
| Mlb/hr | 32.64 | 32.64 | 32.64 | 32.64 | 32.64 | 271.13 | 271.13 | 271.13 |
| Barrel/day | 6,504 | 6,504 | 6,504 | 6,504 | 6,504 | 54,025 | 54,025 | 54,025 |
| Mole Fraction | | | | | | | | |
| Methane | 0.5500 | 0.5500 | 0.5500 | 0.5500 | 0.5500 | 0.5500 | 0.5500 | 0.5500 |
| Ethylene | 0.4500 | 0.4500 | 0.4500 | 0.4500 | 0.4500 | 0.4500 | 0.4500 | 0.4500 |

| Stream | 308 | 309 | 310 | 311 | 312 | 313 | 314 | 315 |
|---|---|---|---|---|---|---|---|---|
| Vap. frac. | 1.0000 | 0.8199 | 0.0000 | 0.0000 | 0.0000 | 0.0148 | 0.4154 | 1.0000 |
| Deg. F. | −8.1 | −49.3 | −91.0 | −130.8 | −156.0 | −158.0 | −135.8 | −93.0 |
| Psia | 507.4 | 505.4 | 503.4 | 501.4 | 499.4 | 176.9 | 174.9 | 172.9 |
| Lbmole/hr | 12,642 | 12,642 | 12,642 | 12,642 | 12,642 | 11,120 | 11,120 | 11,120 |
| Mlb/hr | 271.13 | 271.13 | 271.13 | 271.13 | 271.13 | 238.49 | 238.49 | 238.49 |
| Barrel/day | 54,025 | 54,025 | 54,025 | 54,025 | 54,025 | 47,522 | 47,522 | 47,522 |
| Mole Fraction | | | | | | | | |
| Methane | 0.5500 | 0.5500 | 0.5500 | 0.5500 | 0.5500 | 0.5500 | 0.5500 | 0.5500 |
| Ethylene | 0.4500 | 0.4500 | 0.4500 | 0.4500 | 0.4500 | 0.4500 | 0.4500 | 0.4500 |

| Stream | 316 | 317 | 318 | 319 | 320 | | | |
|---|---|---|---|---|---|---|---|---|
| Vap. frac. | 0.0000 | 0.0000 | 0.0306 | 0.4864 | 1.0000 | | | |
| Deg. F. | −200.2 | −225.1 | −230.1 | −205.2 | −164.0 | | | |
| Psia | 497.4 | 495.4 | 28.2 | 26.2 | 24.2 | | | |
| Lbmole/hr | 1,522 | 1,522 | 1,522 | 1,522 | 1,522 | | | |
| Mlb/hr | 32.64 | 32.64 | 32.64 | 32.64 | 32.64 | | | |
| Barrel/day | 6,504 | 6,504 | 6,504 | 6,504 | 6,504 | | | |
| Mole Fraction | | | | | | | | |
| Methane | 0.5500 | 0.5500 | 0.5500 | 0.5500 | 0.5500 | | | |
| Ethylene | 0.4500 | 0.4500 | 0.4500 | 0.4500 | 0.4500 | | | |
| Exchanger | E1040 | E1041 | E1042 | E1043 | E1044 | E1045 | E1046 | E1047 |
| MMBtu/Hr | 32.22 | 9.30 | 0.91 | 1.41 | 1.23 | 26.46 | 16.45 | 5.07 |
| Exchanger | E1048 | E1049 | E1050 | E1051 | E1052 | E1053 | E1054 | E1055 |
| MMBtu/Hr | 0.59 | 0.94 | 0.81 | 13.72 | 4.79 | 0.98 | 0.85 | 1.41 |
| Exchanger | E1056 | E1057 | E1058 | E1059 | E1060 | E1061 | E1062 | E1063 |
| MMBtu/Hr | 1.19 | 7.26 | 2.84 | 0.52 | 0.01 | 0.29 | 0.02 | 2.65 |

TABLE 4-continued

| Stream | 250 | 251 | 252 | 253 | 254 | 255 | 256 | 258 |
|---|---|---|---|---|---|---|---|---|
| Vap. frac. | 0.0000 | 0.0000 | 0.0227 | 1.0000 | 0.0000 | 0.0000 | 0.0209 | 1.0000 |
| Deg. F. | 64.9 | 64.9 | 59.9 | 90.0 | 29.8 | 29.8 | 24.8 | 59.9 |
| Psia | 575.6 | 575.6 | 376.9 | 374.9 | 573.6 | 573.6 | 245.3 | 243.3 |
| Lbmole/hr | 39,086 | 9,521 | 9,521 | 9,521 | 29,565 | 5,714 | 5,714 | 5,714 |
| Mlb/hr | 1347.35 | 328.21 | 328.21 | 328.21 | 1019.14 | 196.96 | 196.96 | 196.96 |
| Barrel/day | 216,164 | 52.657 | 52,657 | 52,657 | 163,507 | 31,599 | 31,599 | 31,599 |
| Mole Fraction | | | | | | | | |
| Ethylene | 0.2 | 0.2 | 0.2 | 0.2 | 0.2 | 0.2 | 0.2 | 0.2 |
| Ethane | 0.4 | 0.4 | 0.4 | 0.4 | 0.4 | 0.4 | 0.4 | 0.4 |
| Propene | 0.4 | 0.4 | 0.4 | 0.4 | 0.4 | 0.4 | 0.4 | 0.4 |

| Stream | 259 | 260 | 261 | 262 | 263 | 264 | 265 | 266 |
|---|---|---|---|---|---|---|---|---|
| Vap. frac. | 0.0000 | 0.0426 | 1.0000 | 0.0000 | 0.0000 | 0.0232 | 1.0000 | 0.0000 |
| Deg. F. | −8.1 | −18.1 | 24.8 | −49.3 | −49.3 | −54.3 | −13.1 | −91.0 |
| Psia | 571.6 | 131.0 | 129.0 | 569.6 | 569.6 | 71.0 | 69.0 | 567.6 |
| Lbmole/hr | 5,637 | 5,637 | 5,637 | 18,214 | 7,570 | 7,570 | 7,570 | 10,644 |
| Mlb/hr | 194.31 | 194.31 | 194.31 | 627.87 | 260.95 | 260.95 | 260.95 | 366.92 |
| Barrel/day | 31,174 | 31,174 | 31,174 | 100,733 | 41,867 | 41,867 | 41,867 | 58,866 |
| Mole Fraction | | | | | | | | |
| Ethylene | 0.2 | 0.2000 | 0.2000 | 0.2000 | 0.2000 | 0.2000 | 0.2000 | 0.2000 |
| Ethane | 0.4 | 0.4000 | 0.4000 | 0.4000 | 0.4000 | 0.4000 | 0.4000 | 0.4000 |
| Propene | 0.4 | 0.4000 | 0.4000 | 0.4000 | 0.4000 | 0.4000 | 0.4000 | 0.4000 |

| Stream | 268 | 269 | 270 | 271 | 272 | 273 | 274 | 275 |
|---|---|---|---|---|---|---|---|---|
| Vap. frac. | 0.0444 | 1.0000 | 1.0000 | 1.0000 | 1.0000 | 1.0000 | 1.0000 | 1.0000 |
| Deg. F. | −103.0 | −54.3 | 57.8 | 97.0 | 153.2 | 189.0 | 100.0 | 154.8 |
| Psia | 24.7 | 22.7 | 69.0 | 129.0 | 243.3 | 377.9 | 374.9 | 580.6 |
| Lbmole/hr | 10,644 | 10,644 | 10,644 | 18,214 | 23,851 | 29,565 | 29,565 | 39,086 |
| Mlb/hr | 366.92 | 366.92 | 366.92 | 627.87 | 822.18 | 1019.14 | 1019.14 | 1347.35 |
| Barrel/day | 58,866 | 58,866 | 58,866 | 100,733 | 131,907 | 163,607 | 163,507 | 216,164 |
| Mole Fraction | | | | | | | | |
| Ethylene | 0.2000 | 0.2000 | 0.2000 | 0.2000 | 0.2000 | 0.2000 | 0.2000 | 0.2000 |
| Ethane | 0.4000 | 0.4000 | 0.4000 | 0.4000 | 0.4000 | 0.4000 | 0.4000 | 0.4000 |
| Propene | 0.4000 | 0.4000 | 0.4000 | 0.4000 | 0.4000 | 0.4000 | 0.4000 | 0.4000 |

| Stream | 276 |
|---|---|
| Vap. frac. | 0.0000 |
| Deg. F. | 100.0 |
| Psia | 577.6 |
| Lbmole/hr | 39,086 |
| Mlb/hr | 1347.35 |
| Barrel/day | 216,164 |
| Mole Fraction | |
| Ethylene | 0.2000 |
| Ethane | 0.4000 |
| Propene | 0.4000 |

| | | | | | | | | |
|---|---|---|---|---|---|---|---|---|
| Exchanger | E1000 | E1001 | E1002 | E1003 | E1004 | E1005 | E1006 | E1007 |
| MMBtu/Hr | 44.01 | 45.99 | 1.03 | 0.48 | 7.24 | 6.76 | 31.22 | 26.53 |
| Exchanger | E1008 | E1009 | E1010 | E1011 | E1012 | E1013 | E013A | E1013B |
| MMBtu/Hr | 1.18 | 1.05 | 0.54 | 7.31 | 2.68 | 0.62 | 2.16 | 9.31 |
| Exchanger | E1014 | E1015 | E1016 | E1017 | E1018 | E1019 | E1020 | E1021 |
| MMBtu/Hr | 34.68 | 20.08 | 1.26 | 1.12 | 0.57 | 6.85 | 5.69 | 0.55 |
| Exchanger | E1022 | E1023 | E1024 | E1025 | E1026 | E1027 | E1028 | E1029 |
| MMBtu/Hr | 18.16 | 50.47 | 15.03 | 0.90 | 1.35 | 1.20 | 5.80 | 13.37 |
| Exchanger | E1030 | E1031 | E1032 | E1033 | E1034 | E1035 | E1036 | E1037 |
| MMBtu/Hr | 0.60 | 30.73 | 75.49 | 8.15 | 0.83 | 1.26 | 1.11 | 32.06 |
| Exchanger | E1038 | E1039 | E201 | E200 | | | | |
| MMBtu/Hr | 0.61 | 37.88 | 45.90 | 158.34 | | | | |

I claim:

1. A process for partial condensation of a process gas which initially comprises significant amounts of methane and ethylene comprising:

(a) a plurality of sequential. condensation and separation stages comprising, at each condensation and separation stage, condensation of at least part of the process gas and separation of the resulting condensate and remaining process gas; and (b) supplying refrigeration for condensation at each condensation and separation stage by a first mixed refrigerant refrigeration loop, wherein a first mixed refrigerant used therein is comprised substantially of ethylene, ethane, and propylene and the relative proportions of those components remain constant through the first mixed refrigerant refrigeration loop.

2. The process of claim 1 wherein rectification of the process gas occurs between at least two of the sequential condensation and separation stages.

3. The process of claim 2 wherein the rectification of the process gas occurs in demethanization, deethylenization, deethanization, depropylenization or depropanization of the process gas.

4. The process of claim 1 wherein the first mixed refrigerant loop further comprises:

(a) a first compression stage compressing first mixed refrigerant vapor to a first pressure from a second pressure and condensation of the compressed mixed refrigerant vapor to form a high pressure liquid;

(b) subcooling the high pressure liquid;

(c) separating the high pressure liquid to form a first stage refrigerating stream and a first remaining high pressure liquid and flashing the first stage refrigerating stream to the second pressure;

(d) supplying refrigeration to the first condensation and separation stage by vaporizing the flashed first stage refrigerating stream;

(e) subcooling the first remaining high pressure liquid;

(f) separating at least part of the first remaining high pressure liquid to form a second stage refrigerating stream and, if any high pressure liquid remains, a subsequent stage remaining high pressure liquid and flashing the second stage refrigerating stream to a subsequent stage pressure;

(g) supplying refrigeration to a second condensation and separation stage by vaporizing the flashed second stage refrigerating stream;

(h) in a second compression stage, compressing to the second pressure from the subsequent stage pressure the vaporized second stage refrigerating stream; and (i) mixing the compressed vapor of the second compression stage with the vaporized first stage refrigerating stream and compressing the mixed stream in the first compression stage.

5. The process of claim 4 wherein condensation and separation stages subsequent to the second condensation and separation stage comprise:

(a) a subsequent-stage remaining high pressure liquid formed as a diverted portion of the high pressure liquid subcooled to a temperature appropriate for refrigeration of a condensation and separation stage immediately previous to the subsequent condensation and separation stage;

(b) further subcooling the subsequent-stage remaining high pressure liquid;

(c) separating at least part of the subsequent-stage remaining high pressure liquid to form a subsequent stage refrigerating stream and, if any high pressure liquid remains, a next subsequent-stage remaining high pressure liquid;

(d) flashing the subsequent stage refrigerating stream to a subsequent stage pressure, which is significantly lower than the pressure of the vaporized refrigerating stream of the previous condensation and separation stage;

(e) supplying refrigeration to a subsequent stage condensation and separation stage by vaporizing the flashed subsequent stage refrigerating stream;

(f) in a subsequent compression stage, combining the vaporized subsequent stage refrigerating stream and, if any, the vaporized and compressed refrigerating streams of the condensation and separation stages after the subsequent condensation and separation stage to form a subsequent mixed stream and compressing in a subsequent compression stage the subsequent mixed stream to the pressure of the vaporized refrigerating stream of the previous condensation and separation stage; and (g) combining the compressed subsequent mixed stream with the vaporized refrigerating stream of the previous condensation and separation stage to form a previous mixed stream and compressing in a previous compression stage the previous mixed stream.

6. The process of claim 5 wherein one or more condensing process steps in rectification of a cracked or pyrolyzed gas are at least in part accomplished at one or more of the condensation and separation steps.

7. The process of claim 6 wherein first and second high level mixed refrigerant heat transfer stages comprise cooling for portions of the cracked gas with approximate inlet process temperatures of greater than about 100° F. and greater than about 70° F., respectively.

8. The process of claim 6 wherein third and fourth high level mixed refrigerant heat transfer stages comprise cooling for portions of the cracked gas with approximate inlet process temperatures of greater than about 35° F. and greater than about −10° F., respectively.

9. The process of claim 6 wherein a fifth high level mixed refrigerant heat transfer stage comprises cooling for portions of the cracked gas with approximate inlet process temperatures of greater than about −45° F.

10. A process for a thermally linked fractionation combination comprising:

(a) an upper rectification section in a first pressure shell and a lower rectification section in a second pressure shell whereby an upper part of the lower rectification section pressure shell is supportively connected and located immediately inferior to a lower part of the upper rectification section pressure shell;

(b) an upper rectification section stripping section is located in third pressure shell which is supported separately from than that of the pressure shell of the lower or upper rectification section;

(c) the liquid bottom stage stream of the upper rectification section is divided between top stages of the lower rectification section and the upper rectification section stripping section for reflux and stripping feed respectively; and (d) top stage vapor streams from the lower rectification section and the upper rectification section stripping section are combined and introduced to the bottom stage of the upper rectification section to provide stripping vapor.

11. The process of claim 10 wherein two, a first and a second, thermally linked fractionation combinations have an upper rectification section of the second thermally linked fractionation combination which consists of the lower rectification section of the first thermally linked fractionation combination.

12. The process of claim 11 wherein a third thermally linked fractionation combination has an upper rectification section of the third thermally linked fractionation combination which consists of the lower rectification section of the second thermally linked fractionation combination.

13. The process of claim 12 wherein a fourth thermally linked fractionation combination has an upper rectification section of the fourth thermally linked fractionation combination which consists of the lower rectification section of the third thermally linked fractionation combination.

14. The process of claim 13 wherein a fifth thermally linked fractionation combination has an upper rectification section of the fifth thermally linked fractionation combination which consists of the lower rectification section of the fourth thermally linked fractionation combination.

15. The process of claim 14 wherein a pyrolysis-derived gas is fed to the bottom stage of the lower rectification stage of the fifth thermally linked fractionation combination and intercondensing duty is provided to the rectification sections, wherein at least a part of the intercondensing duty is provided by a mixed refrigerant refrigeration loop.

16. The process of claim 14 wherein, between any rectification sections in inferior-superior relationship each other, mechanical barriers to the flow of vapor from an inferior rectification section to a superior rectification section consists essentially of a "chimney" tray or liquid holdup tray that has the capacity of maintaining a liquid level appropriate for withdrawal for use as reflux or column feed.

17. A process for partial condensation of a process gas which initially comprises significant amounts of methane and ethylene comprising:

(a) a plurality of sequential condensation and separation stages comprising, at each condensation and separation stage, condensation of at least part of the process gas and separation of the resulting condensate and remaining process gas, providing the resulting condensate for use as at least part of the refluxing liquid to rectification stages for the process gas; and (b) supplying refrigeration for condensation at each condensation and separation stage by a first mixed refrigerant refrigeration loop, wherein a first mixed refrigerant used therein is comprised substantially of ethylene, ethane, and propylene and the relative proportions of those components remain constant through the first mixed refrigerant refrigeration loop.

18. The process of claim 17 wherein, below the top stage of the rectification stages wherein an intercondenser may operate as a condensation and separation stage, at least two theoretical stages of separation operate between a lower withdrawal stage and an upper return stage for, respectively, removal from and return to the rectification stages of a portion of the process gas.

19. The process of claim 17 wherein the first mixed refrigerant loop further comprises:

(a) a high pressure liquid consisting of first mixed refrigerant;

(b) dividing the high pressure liquid to produce a sequence of successively lower pressure refrigeration streams by:

(i) subcooling to successively lower temperatures at least refrigeration stream parts sequentially divided from the high pressure liquid to form a sequence of refrigeration streams at sequentially lower temperatures;

(ii) flashing each of the subcooled refrigeration streams to sequentially lower pressures lower than high pressure, such that the highest temperature refrigeration stream is flashed to the highest pressure of the sequence of refrigeration stream pressures;

(c) refrigerating condensation and separation stages with the sequence of flashed refrigeration streams to form a sequence of mixed refrigerant vapor streams with identical compositions at a sequence of pressures;

(d) forming a sequence of compression stages wherein a mixed refrigerant vapor at a lower pressure is compressed to and is combined with the next highest pressure mixed refrigerant vapor stream, such that the lowest pressure mixed refrigerant vapor stream is first compressed and mixed with the next highest pressure mixed refrigerant vapor stream and so on until all the mixed refrigerant vapor streams have been compressed to form a combined mixed refrigerant stream; and (e) compressing the combined mixed refrigerant stream to high pressure and condensing the combined mixed refrigerant stream to form the high pressure liquid.

20. The process of claim 19 wherein subcooling of each refrigeration stream part as formed in claim 19(b)(i) comprising the refrigeration stream for a particular condensation and separation stage is done at least in final part at the condensation and separation stage which is refrigerated by that particular refrigerating stream.

21. The process of claim 19 wherein a second mixed refrigerant loop comprises:

(a) a second high pressure liquid at a second high pressure consisting of a second mixed refrigerant comprising substantially methane and ethylene and the relative proportions of those components remain constant through the second mixed refrigerant refrigeration loop;

(b) dividing the next high pressure liquid to produce one or a sequence of successively lower pressure refrigeration streams by:

(i) subcooling to successively lower temperatures at least refrigeration stream parts sequentially divided from the second high pressure liquid to form a sequence of refrigeration streams at sequentially lower temperatures;

(ii) flashing each of the subcooled refrigeration streams to sequentially lower pressures lower than second high pressure, such that the highest temperature refrigeration stream is flashed to the highest pressure of the sequence of refrigeration stream pressures;

(c) refrigerating one or more condensation and separation stages with process gas outlet temperatures lower than the process gas outlet temperatures for the condensation and separation stages refrigerated by the first refrigeration loop and with the sequence of flashed refrigeration streams to form a sequence of mixed refrigerant vapor streams with identical compositions at a sequence of pressures;

(d) forming a sequence of compression stages wherein a mixed refrigerant vapor at a lower pressure is compressed to and is combined with the next highest pressure mixed refrigerant vapor stream, such that the lowest pressure mixed refrigerant vapor stream is first compressed and mixed with the next highest pressure mixed refrigerant vapor stream and so on until all the mixed refrigerant vapor streams have been compressed to form a second combined mixed refrigerant stream; and (e) compressing the combined mixed refrigerant stream to the second high pressure and condensing the second combined mixed refrigerant stream to form the second high pressure liquid.

22. The process of claim 21 wherein condensation and substantial subcooling of the second combined mixed refrigerant stream is done by heat transfer to the first mixed refrigerant refrigeration loop.

23. The process of claim 22 wherein cooling water provides all the condensing duty for forming the high pressure liquid from the combined mixed refrigerant stream.

24. The process of claim 23 wherein the first refrigerant loop comprises 2 to 5 condensation and separation stages and the second refrigerant loop comprises 1 to 4 condensation and separation stages, whereby are provided to a fractionation sequence of rectification sections for cracked gas substantially all external refrigeration by refrigerant streams at less than 100° F. required for rectification of the fractionation sequence.

* * * * *